US011761061B2

(12) United States Patent
Rios et al.

(10) Patent No.: US 11,761,061 B2
(45) Date of Patent: Sep. 19, 2023

(54) ALUMINUM ALLOYS WITH IMPROVED INTERGRANULAR CORROSION RESISTANCE PROPERTIES AND METHODS OF MAKING AND USING THE SAME

(71) Applicants: Orlando Rios, Knoxville, TN (US); Hunter B. Henderson, Knoxville, TN (US); David Weiss, Manitowoc, WI (US); Scott McCall, Livermore, CA (US); Eric Thomas Stromme, Fort Monroe, VA (US); Zachary Cole Sims, Knoxville, TN (US); Ryan Ott, Ames, IA (US); Fanqiang Meng, Ames, IA (US); Michael Kesler, Knoxville, TN (US); Kevin Anderson, Fond du Lac, WI (US)

(72) Inventors: Orlando Rios, Knoxville, TN (US); Hunter B. Henderson, Knoxville, TN (US); David Weiss, Manitowoc, WI (US); Scott McCall, Livermore, CA (US); Eric Thomas Stromme, Fort Monroe, VA (US); Zachary Cole Sims, Knoxville, TN (US); Ryan Ott, Ames, IA (US); Fanqiang Meng, Ames, IA (US); Michael Kesler, Knoxville, TN (US); Kevin Anderson, Fond du Lac, WI (US)

(73) Assignees: UT-Battelle, LLC, Oak Ridge, TN (US); University of Tennessee Research Foundation, Knoxville, TN (US); Eck Industries Incorporated, Manitowoc, WI (US); Lawrence Livermore National Security, LLC, Livermore, CA (US); Iowa State University Research Foundation, Inc., Ames, IA (US)

( * ) Notice: Subject to any disclaimer, the term of this patent is extended or adjusted under 35 U.S.C. 154(b) by 878 days.

(21) Appl. No.: 16/132,231

(22) Filed: Sep. 14, 2018

(65) Prior Publication Data

US 2019/0085431 A1 Mar. 21, 2019

Related U.S. Application Data

(60) Provisional application No. 62/559,136, filed on Sep. 15, 2017.

(51) Int. Cl.
*C22C 21/16* (2006.01)
*C22C 21/12* (2006.01)
(Continued)

(52) U.S. Cl.
CPC ..... *C22C 21/16* (2013.01); *B22D 21/04* (2013.01); *C22C 1/026* (2013.01); *C22C 21/12* (2013.01); *C22C 21/14* (2013.01); *C22C 21/18* (2013.01)

(58) Field of Classification Search
None
See application file for complete search history.

(56) References Cited

U.S. PATENT DOCUMENTS 1,960,916 A * 5/1934 Murphy ..... C22C 21/12 420/534
3,252,841 A 5/1966 Foerster
(Continued)

FOREIGN PATENT DOCUMENTS

CN 104004947 8/2014
CN 104004947 A 8/2014
(Continued)

OTHER PUBLICATIONS

Davis, J.R. "Aluminum and Aluminum Alloys" ASM International, pp. 89, 639. (Year: 1993).*
(Continued)

*Primary Examiner* — George Wyszomierski
*Assistant Examiner* — Janell C Morillo
(74) *Attorney, Agent, or Firm* — Klarquist Sparkman, LLP

(57) ABSTRACT

Disclosed herein are embodiments of aluminum-based alloys having improved intergranular corrosion resistance. Methods of making and using the disclosed alloy embodiments also are disclosed herein.

19 Claims, 18 Drawing Sheets

(51) Int. Cl.

| | |
|---|---|
| ***C22C 21/14*** | (2006.01) |
| ***C22C 21/18*** | (2006.01) |
| ***B22D 21/04*** | (2006.01) |
| ***C22C 1/02*** | (2006.01) |

(56) References Cited

U.S. PATENT DOCUMENTS

| | | | | |
|---|---|---|---|---|
| 4,915,869 | A | 4/1990 | Aubert et al. | |
| 5,037,608 | A | 8/1991 | Tarcy et al. | |
| 5,431,751 | A | 7/1995 | Okochi et al. | |
| 5,578,144 | A | 11/1996 | Satou et al. | |
| 7,811,395 | B2 * | 10/2010 | Pandey | C22C 21/16 420/533 |
| 9,079,211 | B1 | 7/2015 | Deshpande et al. | |
| 9,394,596 | B2 | 7/2016 | Kramer et al. | |
| 9,963,770 | B2 * | 5/2018 | Rios | C22C 21/00 |
| 2003/0183306 | A1 | 10/2003 | Hermann et al. | |
| 2004/0238150 | A1 | 12/2004 | Adachi et al. | |
| 2005/0271543 | A1 | 12/2005 | Pfannen-Mueller et al. | |
| 2009/0288796 | A1 | 11/2009 | Song et al. | |
| 2010/0226817 | A1 | 9/2010 | Pandey | |
| 2010/0282428 | A1 | 11/2010 | Pandey | |
| 2012/0058353 | A1 * | 3/2012 | Komiyama | C22C 21/06 428/457 |
| 2012/0152414 | A1 * | 6/2012 | Che | C22C 21/00 148/549 |
| 2014/0326368 | A1 | 11/2014 | Okamoto | |
| 2015/0135897 | A1 | 5/2015 | Sutcliffe et al. | |
| 2016/0053346 | A1 | 2/2016 | Szuromi et al. | |
| 2018/0237893 | A1 | 8/2018 | Rios et al. | |
| 2018/0291489 | A1 * | 10/2018 | Mann | C22C 21/12 |

FOREIGN PATENT DOCUMENTS

| | | |
|---|---|---|
| DE | 10 2011 111365 | 2/2013 |
| JP | H07 268597 | 10/1995 |
| JP | 3392509 | 3/2003 |
| WO | WO 2002/086175 | 10/2002 |
| WO | WO 2017/007908 | 1/2017 |
| WO | WO 2018/156651 | 8/2018 |

OTHER PUBLICATIONS

Raghavan, V. "Al—Cu—Li (Aluminum-Copper-Lithium)", Journal of Phase Equilibria and Diffusion vol. 31 No. 3, p. 288-290. (Year: 2010).*

Li, J.F. "Corrosion mechanism associated with T1 and T2 precipitates of Al—Cu—Li alloys in NaCl solution", Journal of Alloys and Compounds 460, p. 688-693. (Year: 2008).*

International Search Report and Written Opinion issued for International Application No. PCT/US2018/019046 dated May 9, 2018.

International Search Report and Written Opinion issued for International Application No. PCT/US2018/051218 dated Dec. 21, 2018.

Yao et al., "Effects of La on the age hardening behavior and precipitation kinetics in the cast Al—Cu alloy," *Journal of Alloys and Compounds*, 540(5): 154-158, Jun. 26, 2012.

Fan et al., "Dual characteristic of trace rare earth elements in a commercial casting Al—Cu—X alloy," *Rare Metals*, 34(5): 308-313, May 2015.

Yao et al., "Phase relations in the Cu-poor part of the Ce—Al—Cu system at 503 K," *Journal of Alloys and Compounds*, 484(1-2): 86-89, Sep. 18, 2009.

Abbas, "Effect of high power diode laser surface melting on wear resistance of magnesium alloys," *Wear*, vol. 260, pp. 175-180, May 10, 2005.

Audebert et al., "Production of glassy metallic layers by laser surface treatment," *Scripta Materialia*, 48(3):281-286, Feb. 2003.

Chen et al., "Mechanical Properties of Nanometric Al2O3 Particulate-Reinforced Al—Al11Ce3 Composites Produced by Friction Stir Processing," *Materials Transactions*, 51(5):933-938, Apr. 7, 2010.

Graham et al., "Coarsening of Eutectic Microstructures at Elevated Temperatures," *Transactions of the Metallurgical Society of AIME*, vol. 236, pp. 94-102, Jan. 1966.

International Search Report and Written Opinion issued for International Application No. PCT/US2016/41293 dated Nov. 17, 2016.

International Search Report and Written Opinion issued for International Application No. PCT/US2017/042208 dated Oct. 20, 2017.

International Search Report and Written Opinion issued for International Application No. PCT/US2017/042203 dated Oct. 20, 2017.

Jun et al., "Characterization and wear resistance of laser surface melting AZ91 D alloy," *Journal of Alloys and Compounds*, vol. 455, pp. 142-147, Jan. 16, 2007.

Knipling et al., "Criteria for developing castable, creep-resistant aluminum-based alloys—A review," *Z. Metallkd.*, 97(3):246-265, Mar. 2006.

Non-Final Office Action issued for U.S. Appl. No. 16/132,231 dated Jun. 15, 2021, 15 pages.

Plotkowski et al., "Evaluation of an Al—Ce alloy for laser additive manufacturing," *Acta Materialia*, vol. 126, pp. 507-519, Dec. 27, 2016.

Sims et al., "Cerium-Based, Intermetallic-Strengthened Aluminum Casting Alloy: High-Volume Co-product Development," *JOM*, 68(7):1940-1947, May 23, 2016.

Sims et al., "Characterization of Near Net-Shape Castable Rare Earth Modified Aluminum Alloys for High Temperature Application," *Light Metals*, ed. Edward Williams, pp. 111-114, 2016.

Tomida et al., "Improvement in wear resistance of hyper-eutectic Al—Si cast alloy by laser surface remelting," *Surface and Coatings Technology*, vol. 169-170, pp. 468-471, 2003.

Yilmaz et al., "The microstructure and mechanical properties of unidirectionally solidified Al—Si alloys," *Journal of Materials Science*, vol. 24, pp. 2065-2070, 1989.

Zhang et al., "Effect of substituting cerium-rich mischmetal with lanthanum on microstructure and mechanical properties of die-cast Mg—Al—Re alloys," *Materials and Design*, vol. 30, pp. 2372-2378, Nov. 7, 2008.

* cited by examiner

ALUMINUM ALLOYS WITH IMPROVED INTERGRANULAR CORROSION RESISTANCE PROPERTIES AND METHODS OF MAKING AND USING THE SAME

CROSS REFERENCE TO RELATED APPLICATION

This application claims the benefit of the earlier filing date of U.S. Provisional Application No. 62/559,136, filed on Sep. 15, 2017, the entirety of which is incorporated herein by reference.

ACKNOWLEDGMENT OF GOVERNMENT SUPPORT

This invention was made with government support under Contract Nos. DE-AC05-00OR22725 and DE-AC02-07CH11358 awarded by the U.S. Department of Energy. The government has certain rights in the invention.

FIELD

The present disclosure is directed to new aluminum-based alloys comprising additive components that promote good intergranular corrosion resistance properties and methods of making and using the same.

PARTIES TO JOINT RESEARCH AGREEMENT

The invention arose under an agreement between UT-Battelle, LLC, Lawrence Livermore National Security, LLC, Ames National Security, LLC, University of Tennessee Research Foundation, Eck Industries, and Mercury Marine, a division of Brunswick Corporation and funded by the Critical Materials Institute of the United States Department of Energy, which agreement was in effect on or before the effective filing date of the claimed invention.

BACKGROUND

Intergranular corrosion (IGC) is a type of corrosion characterized by rapid dissolution of areas local to grain boundaries in an alloy. This type of corrosion is especially detrimental to structural metallic products because it causes complete mechanical collapse when only a small fraction of the material has dissolved. In aluminum alloys, this phenomenon commonly occurs in alloys with significant copper additions for strength (greater than 1 wt %). A technology improving intergranular corrosion performance properties of aluminum alloys without compromising properties is needed in the art, particularly for alloys used in corrosive environments.

SUMMARY

Disclosed herein are embodiments of aluminum-based alloys comprising rare earth element additions. The aluminum-based alloys exhibit superior intergranular corrosion resistance. Also disclosed are embodiments of coatings comprising such alloys, and methods of forming such coatings. Also disclosed are methods of making an aluminum-based alloy comprising a rare earth element.

The foregoing and other objects, and features of the present disclosure will become more apparent from the following detailed description, which proceeds with reference to the accompanying figures.

BRIEF DESCRIPTION OF THE DRAWINGS

FIGS. 23A-23F are images obtained from analyzing an A206 alloy comprising 1 wt % cerium, wherein FIGS. 23A and 23B show a portion of the alloy sample selected for focused ion beam analysis; FIG. 23C shows the intermetallics formed in the alloy section; and FIGS. 23D-23F show elemental mapping results for aluminum content (FIG. 23D), copper content (FIG. 23E) and cerium content (FIG. 23F).

DETAILED DESCRIPTION

I. Overview of Terms

Figure 1:
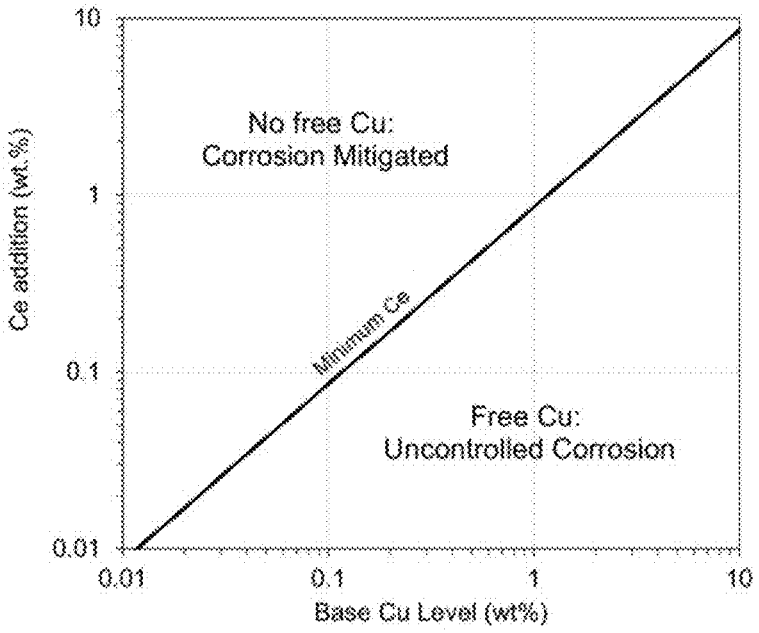
FIG. 1 is a graph of cerium (Ce) addition (wt %) as a function of base copper (Cu) level (wt %), which provides a guide as to amounts of cerium that can be added to a copper-containing alloy to reduce or prevent intergranular corrosion of the alloy.

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and compounds similar or equivalent to those described herein can be used in the practice or testing of the present disclosure, suitable methods and compounds are described below. The compounds, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

In some embodiments, reference is made herein to microstructures and/or alloy embodiments that do not exhibit "substantial intergranular corrosion" (or that exhibit "reduced intergranular corrosion" relative to a conventional alloy without a rare earth element) after solidification. That is, the microstructures and/or alloys are able to resist intergranular corrosion during solidification and/or exhibit less intergranular corrosion during solidification as compared to a conventional alloy without a rare earth element. In some embodiments, a lack of "substantial intergranular corrosion" is evidenced by an amount of intergranular corrosion that is 20% to 100% less than that of a conventional alloy after solidification as quantified by the standard accepted in the field, ASTM G110-92: Standard Practice for Evaluating Intergranular Corrosion Resistance of Heat Treatable Aluminum Alloys by Immersion into Sodium Chloride and Hydrogen Peroxide Solution. This standard evaluation measures the depth of corrosion along and throughout the grain boundaries between grains in the microstructure from the materials external surfaces.

Without wishing to be bound by a particular theory of operation, it currently is believed that much of the intergranular corrosion resistance can be attributed to low or reduced levels of unbound copper, iron, nickel, magnesium, titanium, iron, nickel, manganese, scandium, chromium, and/or silicon present in grain boundaries and/or aluminum matrix portions of the alloy. Thus, in some embodiments, a lack of "substantial intergranular corrosion" can be substantiated by a reduced amount of unbound copper and/or titanium in the alloy matrix and/or grain boundaries as compared to a conventional alloy containing copper and/or titanium. A person of ordinary skill in the art, with the benefit of this disclosure, recognizes when a microstructure or an alloy does not exhibit substantial intergranular corrosion as this can be evaluated using optical microscopy and/or SEM analysis. For example, a person of ordinary skill in the art can compare an SEM or optical micrograph of the inventive alloy embodiments disclosed herein (and the microstructures thereof) with an SEM or optical micrograph of an alloy free of a rare earth element (e.g., Al—Si alloys), and readily recognize that the inventive cast alloys exhibit little to no intergranular corrosion (that is, it does not exhibit substantial intergranular corrosion), whereas the comparative alloy exhibits substantial intergranular corrosion.

The notation "Al-aX," as used in certain embodiments described herein, indicates the composition of an alloy, where "a" is the percent by weight of the rare earth element "X" in the Al-aX alloy. For example, Al-12Ce indicates an alloy of 12 wt % cerium with the balance being aluminum and nonconsequential impurities. In some embodiments, the "Al" component of "Al-aX" may be replaced with a numerical or alphanumeric designation, which is recognized by those of ordinary skill in the art with the benefit of the present disclosure as representing a particular alloy known in the art. For example, A206 is used to represent an aluminum alloy known in the art and "A206-aX" is used to indicate an A206 alloy that has been modified to comprise a particular weight percent ("a") of a rare earth element "X."

The following terms and definitions are provided:

Alloy: A solid or liquid mixture of two or more metals, or of one or more metals with certain metalloid elements.

Aluminum Matrix: The primary aluminum phase present in an aluminum alloy, and in particular embodiments the alloy phase having aluminum atoms arranged in a face-centered cubic structure, optionally with other elements in solution in the aluminum structure.

Dendrite: A characteristic tree-like structure of crystals that grows as molten metal solidifies.

Intermetallic phase: A solid-state compound containing two or more metallic elements and exhibiting metallic bonding, defined stoichiometry and/or ordered crystal structure, optionally with one or more non-metallic elements. In some instances, an alloy may include regions of a single metal (for example, an aluminum matrix) and regions of an intermetallic phase. Ternary and quaternary alloys may have other intermetallic phases including other alloying elements.

Lamella: A thin layer or plate-like structure.

Master Alloy: A feedstock material which has been pre-mixed and solidified into ingots for remelting and part production. In some embodiments, master alloys can be complete mixtures comprising all required elemental additions. In some other embodiments, master alloys can be partial mixtures of elemental elements to which are added additional elements during final processing to bring alloy compositions to the desired final compositions.

Microstructure: The structure of an alloy (e.g., grains, cells, dendrites, rods, laths, lamellae, precipitates, etc.) that can be visualized and examined with a microscope at a magnification of at least 25×. Microstructure can also include nanostructure, which includes structure that can be visualized and examined with more powerful tools, such as electron microscopy, atomic force microscopy, X-ray computed tomography, etc.

Mischmetal: An alloy of rare earth elements, typically comprising 47-70 wt % cerium and from 25-45 wt % lanthanum. Mischmetal may further include small amounts of neodymium, praseodymium, and/or trace amounts (for example, less than 1 wt %) of other rare earth elements, and may include small amounts (for example, up to a total of 15 wt %) of impurities such as iron or magnesium. In some examples, mischmetal comprises 47-70 wt % cerium, 25-40 wt % lanthanum, 0.1-7 wt % Pr, 0.1-17 wt % Nd, up to 0.5 wt % iron, up to 0.2 wt % silicon, up to 0.5 wt % magnesium, up to 0.02 wt % S, and up to 0.01 wt % P. In certain examples, mischmetal comprises 50 wt % cerium, 25-30 wt % lanthanum, with the balance being other rare-earth metals. In one example, mischmetal comprises 50 wt % cerium, 25 wt % lanthanum, 15 wt % Nd, and 10 wt % other rare earth elements and/or iron. In an independent example, mischmetal comprises 50 wt % cerium, 25 wt % lanthanum, 7 wt % Pr, 3 wt % Nd, and 15 wt % Fe.

Molten: As used herein, a metal or alloy is "molten" when the metal has been converted to a liquid form by heating. In some embodiments, the entire amount of metal present may be converted to a liquid or only a portion of the amount of metal present may be converted to liquid (wherein a portion comprises greater than 0% and less than 100% [wt % or vol %] of the amount of metal, such as 90%, 85%, 80%, 70%, 60%, 50%, 40%, 30%, 20%, 10%, 5%, and the like).

Rare Earth Element: An element belonging to the rare earth element class of elements. Also referred to herein as an "REE." As defined by IUPAC and as used herein, the term rare earth element includes the 15 lanthanide elements [namely, lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu)], scandium (Sc), and yttrium (Y).

Theoretical Density: A material density that assumes no material defects or impurities are present. Theoretical density often is used as a measure of the purity of a material. In some embodiments, actual materials can deviate from theoretical density due to inclusion of dissolved gases or other trace impurities.

Vickers Hardness: A hardness measurement determined by indenting the test material with a pyramidal indenter, particular to Vickers hardness testing units, subjected to a load of 50 to 1000 gf for a period of time and measuring the resulting indent size. Vickers hardness may be expressed in units of HV. In particular disclosed embodiments, the Vickers hardness can be measured by as measured by ASTM method E384.

Yield Strength (or Yield Stress): The stress a material can withstand without permanent deformation; the stress at which a material begins to deform plastically.

II. Introduction

As discussed herein, intergranular corrosion is a type of corrosion that is detrimental to structural metallic products because it causes substantial damage when only a small fraction of the material has corroded. While alloying elements can be added to aluminum alloys for multiple purposes such as grain refinement, strengthening by solid solution or precipitation, etc., these alloying elements can also have negative impacts on the corrosion resistance of aluminum alloys. In particular, copper additions to aluminum can be made to improve strength (primarily by precipitation strengthening), and many of these alloys have good mechanical properties, However, copper precipitates faster at grain boundaries, causing more precipitate on the grain boundary itself, a precipitate free zone next to the grain boundary, and fine matrix precipitate in the center of the grains. The precipitate free zone is depleted in copper and a local galvanic cell is established between the precipitate free zone and both the adjacent grain boundary and grain matrix. The precipitate free zone is anodic to both the grain boundary and grain matrix and therefore corrodes. Typically, the galvanic potential is 0.020V or more between these different microstructural regions when IGC is severe. This difference in composition across the grain leads directly to intergranular corrosion in the precipitate free zones on each side of the grain boundaries, and poor corrosion performance. Most aluminum alloys that have good corrosion resistance have tight limitations (typically, <0.6 wt. %) on the amounts of copper that can be included in the alloy, but these limitations can increase costs significantly. Most methods of improving IGC involve alternative heat treatment schedules that reduce the degree of grain boundary precipitation and size of the associated precipitate free zones; however, such methods vary in their degree of effectiveness.

Recycling aluminum alloys is economically advantageous, mostly because of the enormous energy expenditure to transform mined bauxite to aluminum metal of 44,711 Btu/Lb. Conventional alloys can have considerable additions of elements like copper, iron, silicon, magnesium, manganese, zinc, and nickel, which can compromise properties of recycled alloys. Copper is frequently the limiting factor for determining which alloys can be recycled, predominantly because of corrosion concerns. The copper content of many primary alloys (made from only virgin metal from a reduction cell) is limited to 0.01%-0.03%, meaning no copper-containing alloys can enter associated recycling streams. This complexity necessitates sorting operations reducing the efficiency and increasing the costs of recycling.

Additionally, titanium can have detrimental effects on some die cast and other aluminum alloys during solidification and thus it can be beneficial to scavenge this additional element to prevent its presence in the alloy and/or at the grain boundaries of the alloy.

The disclosed technology addresses these deleterious issues by providing alloys with rare earth element additions that reduce IGC and that also can include higher amounts of recycled components without sacrificing mechanical properties and/or performance. As such, the alloy embodiments disclosed herein can have implications for aluminum recycling because higher amounts of elements like copper, titanium, cerium, lanthanum, and/or magnesium, can be included without detrimental effects on product mechanical strength. Additionally, the present inventors have determined that adding a rare earth element to aluminum alloys coatings can improve corrosion properties of alloys. Such properties can include improved adhesion of the formed outer oxide layer to the alloy and uniformity of the outer oxide layer itself. Such alloys can be used to make structural materials that are subject to extreme thermal and/or chemical environments and thus mitigate the need for additional protective coatings to inhibit corrosion and/or oxidation. The disclosed alloys embodiments are ideal for products because they exhibit enhanced corrosion resistance relative to most commercial aluminum alloys. Furthermore, the coatings of the present disclosure can be applied by numerous techniques without the need for post heat treatments to achieve desired mechanical properties.

III. Alloy Embodiments

Disclosed herein are aluminum alloys comprising a rare earth element additive. The disclosed alloys exhibits little to no intergranular corrosion. As illustrated by the present disclosure, additions of a rare earth to aluminum-based alloys facilitates disruption of corrosion and detrimental impurity effects by occupying grain boundary areas, thereby altering the local chemistry. Representative embodiments use cerium, lanthanum, mischmetal, or combinations thereof. Without being limited to a single theory, it currently is believed that rare earth elements have little to no solubility in aluminum, and thus including these elements in aluminum-based alloys facilitates an outcome whereby these elements are pushed to grain boundaries during solidification when forming products using aluminum-based alloys. Even during heat treatment, it is currently believed that their insolubility causes them to remain in grain boundaries rather than diffusing through the aluminum matrix. The present disclosure illustrates that while present in grain boundaries, rare earth elements alter the behavior of local impurities, such as by scavenging local impurity elements to form intermetallics, and by occupying space in the grain boundary, which would otherwise act as a high diffusion pathway. As such, including these rare earth elements in aluminum-based alloys facilitates disrupting the depletion zone formation mechanism responsible for IGC, thereby reducing or eliminating the effect. Additionally, the present disclosure illustrates that intermetallics formed between aluminum and the rare earth elements are capable of scavenging "impurity" elements, such as iron, magnesium, titanium, and silicon, and thus can eliminate their detrimental effects. In some embodiments, a rare earth element, such as cerium, can scavenge titanium to form an $Al_{20}CeTi_2$ phase and can thereby prevent deleterious effects that the titanium may have on the alloy.

It is to be understood that wherever cerium is mentioned herein, lanthanum and/or mischmetal can be substituted for a portion of, or all of, the cerium, unless stated otherwise. In some embodiments, the rare earth element-modified aluminum alloys described herein can further comprise additional alloying elements and/or additives, such as magnesium, iron, manganese, zinc, titanium, zirconium, vanadium, copper, nickel, scandium, and any combinations thereof. In particular disclosed embodiments, the rare earth element-modified aluminum alloy comprises, consists essentially of, or consists of (i) aluminum; (ii) at least one rare earth element; and (iii) copper, iron, nickel, magnesium, titanium, iron, nickel, manganese, scandium, chromium, and/or silicon. In yet additional embodiments, the rare earth element-modified aluminum alloy comprises, consists essentially of, or consists of (i) aluminum and (ii) at least one rare earth element, and (iii) one or more additive components. In yet additional embodiments, the rare earth element-modified aluminum alloy comprises, consists essentially of, or consists of (i) aluminum, (ii) at least one rare earth element, and (iii) one or more additional alloying elements selected from iron, copper, silicon, magnesium, or any combination thereof. In yet additional embodiments, the rare earth element-modified aluminum alloy comprises, consists essentially of, or consists of (i) aluminum; (ii) cerium or lanthanum (or combination thereof); and (iii) magnesium, iron, titanium, silicon, copper, or any combination thereof. "Consists essentially of" (or "consisting essentially of") means that the alloy does not include additional components, or amounts of such additional components, that would materially affect the ability of the alloy to prevent or inhibit IGC and/or that would result in a non-uniform (or substantially non-uniform) coating layer. Alloy embodiments described herein also can contain innocuous amounts of various impurities that have no substantial effect on the chemical and/or mechanical properties of the alloys.

The rare earth element can be included in the aluminum alloy in an amount ranging from 0.5 wt % to 12 wt %, such as 0.5 wt % to 8 wt %, or 0.5 wt % to 6 wt %, or 0.5 wt % to 3 wt %, or 0.5 wt % to 1 wt %. In some embodiments, the rare earth element can be included in the aluminum alloy in an amount selected from 12 wt %, 8 wt %, 6 wt %, 3 wt %, 1 wt %, or 0.5 wt %. In particular disclosed embodiments, the rare earth element is cerium, lanthanum, mischmetal, or any and all combinations thereof. The aluminum alloy can further comprise copper, iron, silicon, titanium, nickel, zinc, vanadium, zirconium, manganese, chromium, silicon and/or magnesium in the following amounts: copper (0.1 wt % to 7 wt %, such as 0.1 wt % to 4 wt %, or 0.1 wt % to 1 wt %, or 7 wt %, 4 wt %, 1 wt %, or 0.1 wt %); iron (0.1 wt % to 2 wt %, or 0.1 wt % to 1 wt %, or 0.1 wt % to 0.5 wt %, or 2 wt %, 1 wt %, 0.5 wt %, or 0.1 wt %); silicon (0.1 wt % to 10 wt %, such as 0.1 wt % to 5 wt %, or 0.1 wt % to 1 wt %, or 10 wt %, 5 wt %, 1 wt %, or 0.1 wt %); titanium (0.02 wt % to 0.3 wt %, such as 0.1 wt % to 0.3 wt %, or 0.2 wt % to 0.3 wt %); magnesium (0.1 wt % to 8 wt %, such as 0.1 wt % to 5 wt %, or 0.1 wt % to 3 wt %, or 0.1 wt % to 1 wt %, or 8 wt %, 5 wt %, 1 wt %, or 0.1 wt %); scandium (0.01 wt % to 1.5 wt %, or 0.01 wt % to 1 wt %, or 0.01 wt % to 0.5 wt %).

In particular embodiments, the rare earth element can be included in the aluminum alloy at a particular ratio relative to an element in the aluminum alloy that can deleteriously effect corrosion resistance, or mechanical properties, or both (exemplary such elements can include copper, iron, nickel, magnesium, titanium, manganese, scandium, chromium, zinc, vanadium, zirconium and/or silicon). In some embodiments, the rare earth element can be included at a particular ratio relative to an amount of copper present in the alloy. In such embodiments, the rare earth element can be used to absorb a substantial amount of copper present in the alloy to thereby prevent the copper from reducing corrosion resistance by existing in the aluminum matrix. In fact, the present inventors have determined that binary intermetallics formed between aluminum and the rare earth element (for example, $Al_{11}REE_3$, such as $Al_{11}Ce_3$ or $Al_{11}La_3$) are capable of exhibiting solubility for copper, which, prior to the present disclosure, was not known or appreciated. In some embodiments, a majority amount of copper and/or iron present in an aluminum alloy can be solubilized or bound in such an intermetallic phase, such as 80% of any copper and/or iron present in grain boundaries of the alloy or at least 40% of all copper and 60% of all iron of the alloy is contained in the intermetallic phase. In some such embodiments, the rare earth element can be added in an amount (based on atomic %) that provides a ratio of Cu:REE in a binary aluminum/REE intermetallic phase of 2.1:1 to higher than 2.1:1, such as 2.2:1 to 3:1, or 2.5:1 to 3:1, or 2.6:1, or 2.7:1 (wherein REE represents a single rare earth element, a combination of rare earth elements, mischmetal, or combinations thereof). In particular embodiments, the rare earth element is present in an amount that provides an Cu:REE ratio in the $Al_{11}REE_3$ binary intermetallic phase of 2.18:1 or 2.57:1. In particular embodiments having these particular ratios, the rare earth element is cerium, lanthanum, or mischmetal. Solely by way of example, if an aluminum alloy comprises 0.4 atomic % copper, then corrosion resistance of that aluminum alloy can improved by adding 0.2 atomic % of a rare earth element, such as cerium, lanthanum, or mischmetal. The corrosion resistance is improved as the aluminum alloy exhibits less corrosion (for example, 20% to 100% less IGC corrosion penetration distance) than is exhibited by the same aluminum alloy without the rare earth element addition. Also disclosed herein are embodiments of an aluminum alloy comprising a rare earth element (REE) and aluminum grains, wherein a boundary between the aluminum grains contain more than 10 wt % of the REE by volume within 5 μm perpendicular of the boundary.

In some embodiments, the rare earth element can be added in an amount that provides a particular ratio relative to titanium included in the alloy to thereby prevent any deleterious effects on mechanical properties. It is known in the art that titanium can deleterious effect mechanical properties of aluminum alloys. The present inventors have determined that such effects can be reduced by scavenging, within intermetallic phases of the alloy, a substantial amount (if not all) of the titanium present in the aluminum alloy. In some embodiments, the aluminum alloy can comprise amounts of titanium, aluminum, and a rare earth element that form a ternary intermetallic phase having a formula $Al_{20}(REE)Ti_2$, such as $Al_{20}CeTi_2$. In some embodiments, the rare earth element can be present in an amount (in atomic %) that provides an REE:Ti ratio of 0.3:1 to higher than 0.3:1, such as 0.39:1 to 0.8:1, or 0.56:1 to 0.8:1, or 0.6:1 to 0.8:1. In particular embodiments, the rare earth element is present in an amount that provides an REE:Ti ratio of 0.39:1 or 0.56:1. In embodiments having these particular ratios, the rare earth element is cerium, lanthanum, or mischmetal.

In yet some additional embodiments, the aluminum alloy can comprise copper, aluminum, and a rare earth element in amounts (based on atomic %) that provide any of the following ratios: Cu:REE:Al=1:1:3; Cu:REE:Al=4:1:8; or Cu:REE:Al=7:2:10. Such ratios can provide intermetallics having formulas selected from $Cu(REE)Al_3$, $Cu_4(REE)Al_8$, $Cu_7(REE)_2Al_{10}$, respectively. In other embodiments, the aluminum alloy can be one that forms an $Al_{11}(REE)_3$ intermetallic that contains copper and thus can have a formula $Cu_a(REE)_bAl_c$ according to the formula $x(Al_{11}(REE)_3)+yCu=>Cu_a(Ce,La)_bAl_c$, wherein a=y, b=x*11, and c=x*3. In some embodiments, the formula can be $8Cu(REE)Al_3$, $3Cu_4(REE)Al_8$, or $3Cu_7(REE)_2Al_{10}$.

IV. Methods

The alloy embodiments described herein can be made by adding at least one rare earth element to an aluminum alloy composition. In some embodiments, the aluminum alloy can comprise aluminum, magnesium, copper, nickel, silicon, zinc, iron, manganese, titanium, vanadium, zirconium, or other metals. In particular embodiments, the aluminum alloy can comprise amounts of copper, magnesium, and/or silicon that typically contribute to corrosion of the alloy or an amount of titanium that contributes to a reduction in the alloy's mechanical strength. The present inventors have determined that adding amounts of a rare earth element to such alloys can reduce the amount of corrosion that the alloy exhibits and/or can prevent mechanical strength reduction of the alloy.

The amount of the rare earth element added to the aluminum alloy composition can be determined based on the ratios discussed above. In certain embodiments, the rare earth element is added in amounts that range from greater to zero wt % to 8 wt % or higher, with some embodiments comprising the rare earth element in an amount ranging from 0.1 wt % to 12 wt %, such as 0.5 wt % to 8 wt %, or 0.5 wt % to 6 wt %, or 0.5 wt % to 3 wt %, or 0.5 wt % to 1 wt %. In yet additional embodiments, a minimum amount of a rare earth element, such as cerium, needed to solubilize copper in an Al-REE intermetallic can be determined using the graphical plot provided in FIG. 1. Typically, the aluminum alloy is melted and then the rare earth element is added to the melt. The mixture can then be cast in a permanent mold or other mold and allowed to solidify.

In some embodiments, the following information and formulas can be used to calculate an amount of an alloying component, such as copper, that may be included in an aluminum alloy to obtain a desired enrichment level in the aluminum matrix, as a function of adding an rare earth element, without deleteriously affecting the corrosion resistance and/or mechanical properties of the aluminum alloy. Such alloying components can include, but are not limited to, copper, titanium, magnesium, and silicon. These formulas and information can be used as a metric to attain a desired level of alloying component enrichment in the matrix while still allowing for reduced intergranular corrosion (by way of facilitating solubility of the alloying components, like copper, magnesium, titanium, and/or silicon, in intermetallic phases of the alloy, particularly those that form at grain boundaries) and/or good mechanical properties. With reference to the equations below, "a" is the base element, "b" is a soluble alloying component in primary phase "a," and "z" is an insoluble alloying component that forms an intermetallic ("ω") with element "a," and also having solubility for "b." Also, certain assumptions are included in using these formulas, namely that the insoluble element "z" interacts with soluble element "b," the max solubility of soluble element "b" is constant within the matrix phase, the main intermetallic "ω" is saturated with "b" to a constant value, also that all "b" not in "ω" is in solution in "α."

Equation to calculate fraction matrix (assuming the intermetallic swells):

$$f_\alpha = 1 - R\left(1 - \frac{(C'_{z,\omega} - C_{z,t})}{C'_{z,\omega}}\right)$$

Equation to calculate fraction of "b" in the intermetallic:

$$C_{b,tot,\omega} = C_{z,tot} \cdot C_{b,\omega}''/C_{z,\omega}$$

Equation to calculate the amount needed to enrich the matrix:

$$C_{b,tot,\alpha} = C_{b,\alpha,max} \cdot f_{b,target}$$

Equation to combine for total "b" addition $$C_{b,tot} = C_{b,tot,\omega} + C_{b,tot,\alpha}$$

With reference to the above formulas, the following variables are described:

$f_\alpha$ is the fraction of solid-solution phase a when phase w is saturated with b; $f_\omega'$ is the fraction of phase w in alloy with zero b uptake; $f_\omega''$ is the fraction of phase w in alloy when saturated with b; R is the ratio of volume fractions of ω, $=f_\omega''/f_\omega'$; $C_{b,tot}$ is the concentration of soluble element b in overall alloy; $C_{b,tot,\omega}$ is the concentration of soluble element b in overall alloy that is trapped in phase ω; $C_{z,tot}$ is the concentration of insoluble element z in overall alloy; $C_{b,\omega}$ is the saturated concentration of element b in phase ω; is the internal concentration of element z in phase ω, zero b uptake; $C_{z,\omega}''$ is the internal concentration of element z in phase ω, zero b uptake; $C_{b,\alpha,max}$ is the maximum solid solubility of element b within phase α; and $f_{b,target}$ is the desired fraction of max solid solubility of element b in phase α

This relationship can be used to normalize effective alloying element potency and currently is believed to work for both atomic and weight percent, as long as they are kept consistent throughout the calculation. The calculations also currently are believed to be applicable even if w transforms to another phase; however, it may be beneficial to assess molar volumes in such instances.

Figure 2:
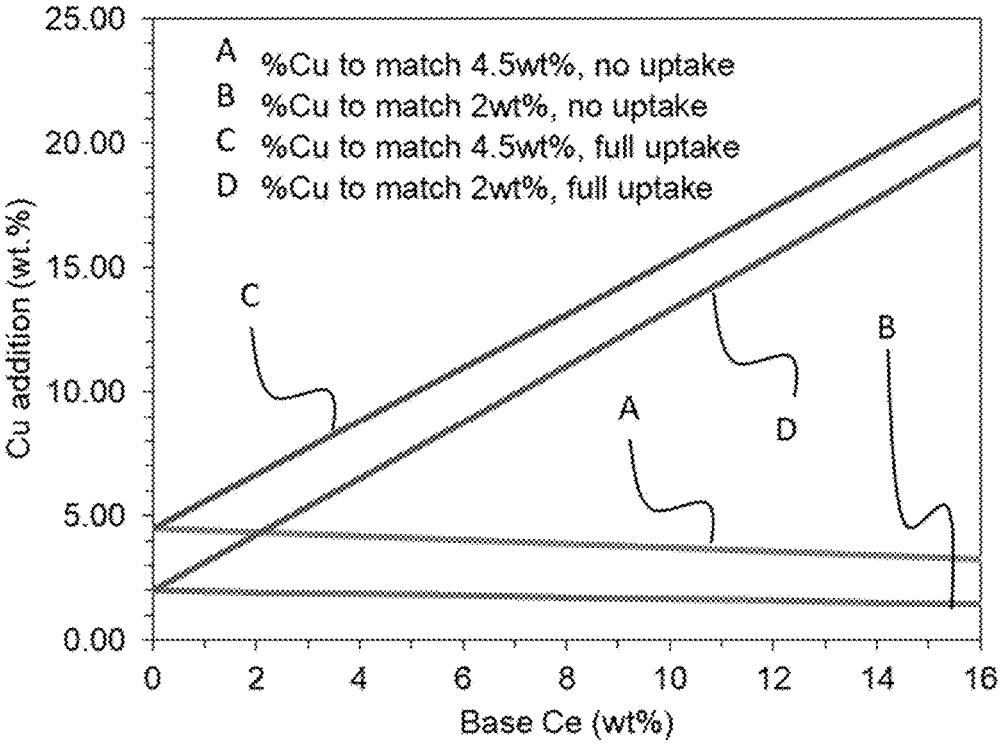
FIG. 2 is a graph of copper addition (wt %) as a function of base cerium amounts (wt %), which provides an additional guide as to the amount of copper that can be added to an alloy to reach standard alloying levels (e.g., 2 wt % and 4.5 wt %) in the alloy matrix, even after saturating cerium phases within the alloy with copper.
Figure 3A:
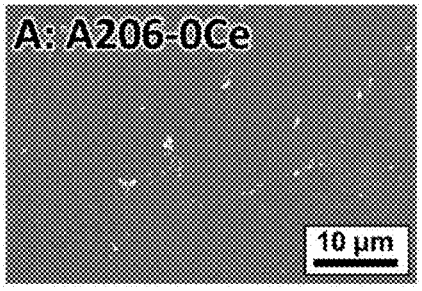
FIGS. 3A-3D are backscattered scanning electron microscopy (BS-SEM) images of an aluminum alloy comprising 0 wt % cerium (FIG. 3A), 0.5 wt % cerium (FIG. 3B), 1.0 wt % cerium (FIG. 3C), and 8 wt % cerium (FIG. 3D).
Figure 3B:
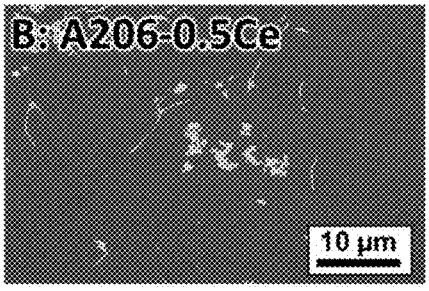
Figure 3C:
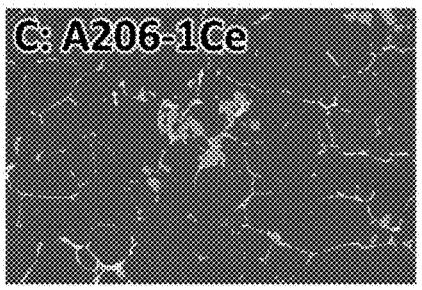
Figure 3D:
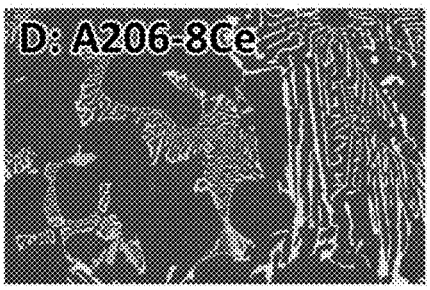

In a representative embodiment, an amount of copper needed to reach alloying levels of 2 wt % and 4.5 wt % (which are generally recognized standard copper alloying levels) in an alloy matrix after saturating any rare earth element phases was determined using the above equations and information. The results are illustrated graphically in FIG. 2.

Also disclosed herein are method embodiments for making alloys having coating that exhibits reduced corrosion. Methods for making such alloy embodiments include adding an amount of a rare earth element to an alloy to form a rare earth element-modified alloy. The rare earth element-modified alloy can be subjected to post-processing application/surface depositions (e.g., cold spray, plasma spray, roll bonding and other such processes) whereby at least a portion of the rare earth element-modified alloy or conventional Al alloy is coated. The method can be applied to alloys that are not typically prone to coating, such as die cast alloys. Without being limited to a particular theory, it currently is believed that the rare earth element-modified alloys are able to convert the coating process to a planar coating process, which contributes to corrosion resistance, adhesion, and uniform thickness of the outer intermetallic-containing layer. Typically, the portion of the rare earth element-modified alloy that becomes coated is an outer surface layer of the alloy. This outer surface layer has an even (or substantially even) thickness that does not increase or decrease in thickness by more than 50% to 150% (relative to the average distance from the metal matrix to the coated outer surface layer). The coated outer surface layer also exhibits adhesion to the remaining structure of the rare earth element-modified alloy, i.e. it does not detach from the matrix spontaneously or under light abrasion. This is evident in a sharp transition between the base material and coating without macro or microscopic defects in the form of voids, pores or spallation of coating.

The rare earth element-modified alloy embodiments disclosed herein can be used to relax copper specifications on heat-treatable, aluminum alloys that may be exposed to corrosive environments and/or to design new high-strength copper-containing alloys having improved corrosion resistance (such as intergranular corrosion resistance). Also, the disclosed rare earth element-modified alloys/compositions can serve as corrosion resistance coatings that have high strength and avoid the need for any post-heat treatments.

In particular embodiments, the method comprises melting a solid aluminum-based alloy comprising aluminum, copper, iron, magnesium, and titanium and that is free of a rare earth element to provide a molten aluminum-based alloy; adding to the molten aluminum-based alloy a rare earth element (REE) to form a molten REE-modified aluminum-based alloy, wherein the REE is added in an amount sufficient to form an aluminum-REE intermetallic capable of isolating an amount of the copper or the titanium present in the molten REE-modified aluminum-based alloy from an aluminum matrix; and allowing the molten REE-modified aluminum-based alloy to solidify, thereby providing a solidified molten REE-modified aluminum-based alloy having increased intergranular corrosion resistance as compared to a solidified aluminum-based alloy that is not modified with an REE. In particular embodiments, the solid aluminum-based alloy used in the melting step of the method is a conventional aluminum alloy, such as A206, 535, 6061, and 356. In some embodiments, adding the REE changes the chemical composition of grain boundary precipitates within the molten aluminum-based alloy such that the grain boundary precipitates become more anodic than grain boundary precipitates present in a solidified aluminum-based alloy that is not modified with an REE. In additional embodiments, adding the REE changes the chemical composition of grain boundary precipitates within the molten aluminum-based alloy such that the galvanic potential difference between the grain boundary precipitates and precipitate free zones and the galvanic potential difference between the grain boundary precipitates and a grain matrix are both less than 0.020V. In some embodiments, this method can be used to make an alloy comprising copper; a REE in an amount ranging from greater than 0 wt % to 4 wt %; magnesium in an amount ranging from greater than 0 wt % to 3 wt %; iron in an amount ranging from greater than 0 wt % to 2 wt %; titanium in an amount ranging from greater than 0 wt % to 0.3 wt %; and a balance weight percent made up of aluminum or aluminum and trace impurities.

Also disclosed herein are method embodiments for forming coated base alloys, such as conventional alloys that do not comprise a REE (for example, alloys A206, 535, 6061, and 356). In some embodiments, the method comprises forming a coating on a base alloy (e.g., A206, 535, 6061, and 356) by depositing an embodiment of a REE-containing alloy described herein on a surface of the base alloy, wherein the base alloy is more susceptible to corrosion than the REE-containing alloy. The coating can be deposited by methods including, but not limited to, cold spray; twin-wire arc; thermal spray (e.g., plasma spray and high-velocity oxy-fuel); roll bonding; electrodeposition; physical vapor deposition and additive manufacturing (e.g., directed energy deposition). In some embodiments, the coating forms a strong metallurgical bond with the underlying base alloy. In some embodiments, the coating is strongly adhered to the base alloy and exhibits high thermal stability. The coating also retains high strength and prevents oxidation of the base alloy at elevated processing or service temperatures (e.g., temperatures above the melting temperature of the base alloy).

Products comprising the rare earth element-modified alloy embodiments disclosed herein also can be made. Any product or product component that may be susceptible to corrosion (or that may be exposed to an aqueous environment) may include the rare earth element-modified alloy embodiments of the present disclosure. In some embodiments, aerospace structural components, automotive structural components, locomotive structural components, and nautical structural components can be made using the disclosed rare earth element-modified alloy embodiments or can be modified to comprise a coating formed from depositing a rare earth element-modified alloy composition disclosed herein. In additional embodiments, the rare earth element-modified alloy embodiments of the present disclosure can be used as magnetic alloy coatings. The coating can be deposited by methods including, but not limited to cold spray; thermal spray deposition (e.g., plasma spray deposition); twin-wire arc; high-velocity oxy-fuel (HVOF); additive manufacturing (e.g., directed energy deposition); roll bonding; electrodeposition and physical vapor deposition. For many of the above-mentioned techniques, a coating is applied using a powder precursor.

V. Overview of Several Embodiments

Disclosed herein are embodiments of an aluminum alloy, comprising copper and iron and further having an intermetallic phase meeting a formula $Al_{11}REE_3$, wherein Al is aluminum and REE is a rare earth element selected from cerium, lanthanum, or a combination thereof and at least 40% of all copper and 60% of all iron present in the aluminum alloy is contained in the $Al_{11}REE_3$ intermetallic phase.

In some embodiments, the aluminum alloy comprises copper in grain boundaries of the aluminum alloy and wherein 80% of any such copper present is contained in the $Al_{11}REE_3$ intermetallic phase.

In any or all of the above embodiments, the REE is cerium.

In any or all of the above embodiments, the Al-REE binary intermetallic phase comprises an atomic % of copper and an atomic % of the REE that provides a ratio of REE to copper that ranges from 2.1:1 to higher than 2.1:1.

In any or all of the above embodiments, the ratio of REE to copper ranges from 2.1:1 to 3.1.

In any or all of the above embodiments, the ratio of REE to copper ranges from 2.1:1 to 2.6:1.

In any or all of the above embodiments, the alloy comprises one or more intermetallics having a formula selected from $Cu(REE)Al_3$, $Cu_4(REE)Al_8$, or $Cu_7(REE)_2Al_{10}$.

In any or all of the above embodiments, the REE is present in an amount ranging from greater to 0 wt % to 4 wt %.

In any or all of the above embodiments, the REE is present in an amount ranging from 0.1 wt % to 1 wt %.

In any or all of the above embodiments, the copper is present in an amount ranging from 0.1 wt % to 7 wt %.

In any or all of the above embodiments, the alloy further comprises magnesium in an amount ranging from greater than 0 wt % to 3 wt %; iron in an amount ranging from greater than 0 wt % to 2 wt %; and/or titanium in an amount ranging from greater than 0 wt % to 0.3 wt %.

In any or all of the above embodiments, the aluminum alloy includes titanium and further comprises an Al-REE-Ti ternary intermetallic phase and wherein the Al-REE-Ti ternary phase comprises an atomic % of titanium and an atomic % of the REE that provides a ratio of REE to titanium ranging from 0.3:1 to higher than 0.3:1.

In any or all of the above embodiments, the alloy further comprises silicon, manganese, zinc, chromium, or zirconium.

Also disclosed herein are embodiments of an aluminum alloy, comprising: copper; a rare earth element (REE) in an amount ranging from greater than 0 wt % to 4 wt %; magnesium in an amount ranging from greater than 0 wt % to 3 wt %; iron in an amount ranging from greater than 0 wt % to 2 wt %; titanium in an amount ranging from greater than 0 wt % to 0.3 wt %; and a balance weight percent made up of aluminum or aluminum and trace impurities.

Also disclosed herein are embodiments of an aluminum alloy comprising a rare earth element (REE) and aluminum grains, wherein a boundary between the aluminum grains contain more than 10 wt % of the REE by volume within 5 μm perpendicular of the boundary.

Also disclosed herein are embodiments of a method for making an alloy, comprising: melting a solid aluminum-based alloy comprising aluminum, copper, iron, magnesium, and titanium and that is free of a rare earth element to provide a molten aluminum-based alloy; adding to the molten aluminum-based alloy a rare earth element (REE) to form a molten REE-modified aluminum-based alloy, wherein the REE is added in an amount sufficient to form an aluminum-REE intermetallic capable of isolating an amount of the copper or the titanium present in the molten REE-modified aluminum-based alloy from an aluminum matrix; and allowing the molten REE-modified aluminum-based alloy to solidify, thereby providing a solidified molten REE-modified aluminum-based alloy having increased intergranular corrosion resistance as compared to a solidified aluminum-based alloy that is not modified with an REE.

In any or all of the above embodiments, adding the REE changes the chemical composition of grain boundary precipitates within the molten aluminum-based alloy such that the grain boundary precipitates become more anodic than grain boundary precipitates present in a solidified aluminum-based alloy that is not modified with an REE.

In any or all of the above embodiments, adding the REE changes the chemical composition of grain boundary precipitates within the molten aluminum-based alloy such that the galvanic potential difference between the grain boundary precipitates and precipitate free zones and the galvanic potential difference between the grain boundary precipitates and a grain matrix are both less than 0.020V.

In any or all of the above embodiments, the presence of the Al-REE intermetallic capable of isolating an amount of the copper or the titanium present in the molten REE-modified aluminum-based alloy from an aluminum matrix is determined using scanning electron microscopy and/or energy dispersive spectroscopy.

In any or all of the above embodiments, the amount of the REE added to the molten aluminum-based alloy ranges from greater than 0 wt % to 4 wt %.

In any or all of the above embodiments, the amount of the REE added to the molten aluminum-based alloy ranges from 0.1 wt % to 1 wt %.

Also disclosed herein are embodiments of a method, comprising forming a coating on a base alloy by depositing an aluminum alloy embodiment disclosed herein a surface of the base alloy, wherein the base alloy is more susceptible to corrosion than the aluminum alloy.

In any or all of the above embodiments, depositing comprises cold spray deposition, twin-wire arc deposition, thermal spray deposition, roll bonding deposition, electrodeposition, physical vapor deposition, or additive manufacturing deposition.

VI. Examples

Example 1

In this example, cerium was added to a high performance A206 alloy to mitigate the corrosion effects of copper and Ti. Alloys were designed to either have excess or deficient cerium contents to mitigate the existing Cu. Microstructures for A206 containing 0 wt %, 0.5 wt %, 1.0 wt % and 8.0 wt % cerium are provided by FIGS. 3A, 3B, 3C, and 3D, respectively, with the corresponding compositions provided by Table 1. These alloys served to determine the copper scavenging efficacy of cerium additions to the alloy and investigate cerium to copper to titanium ratios. The 8 wt % cerium alloy served to confirm that cerium can fully scavenge copper, while the 0.5 wt % and 1 wt % cerium alloys were used to saturate the scavenging power of cerium and determine necessary addition ratios.

TABLE 1

| Chemical | Aluminum at % | Mg at % | Ce at % | Ti at % | Mn at % | Cu at. % |
|---|---|---|---|---|---|---|
| A206-0.5Ce | 96.86 | 0.36 | 0.10 | 0.03 | 0.23 | 2.43 |
| A206-1Ce | 96.94 | 0.35 | 0.37 | 0.12 | 0.20 | 2.03 |
| A206-1Ce | 96.98 | 0.31 | 0.35 | 0.09 | 0.20 | 2.06 |
| A206-8Ce | 96.06 | 0.90 | 1.20 | 0.00 | 0.17 | 1.67 |
| A206-8Ce | 95.74 | 0.51 | 1.35 | 0.09 | 0.00 | 2.14 |

Figure 4:
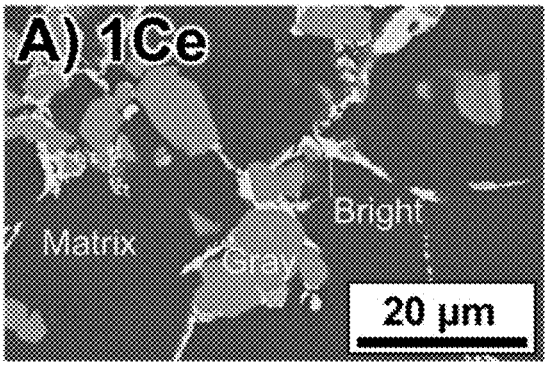
FIG. 4 is an SEM image showing the internal phase structure of an aluminum alloy comprising 1 wt % cerium.
Figure 5:
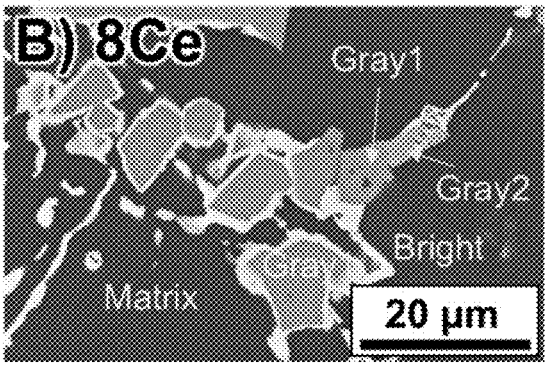
FIG. 5 is an SEM image showing the internal phase structure of an aluminum alloy comprising 8 wt % cerium.

FIGS. 4 and 5 show details of the internal phases in the alloy comprising 1 wt % cerium and 8 wt % cerium after heat treatment. FIG. 4 shows a matrix phase, a bright phase, and a gray phase. FIG. 5 shows a matrix phase, two gray phases, and a bright phase. The corresponding compositions as measured by EDS of these two embodiments are provided below in Tables 2 and 3.

TABLE 2

Compositions of Phases in FIG. 4

| Phase | Al | Ti | Cu | Ce |
|---|---|---|---|---|
| Matrix | 98.4 | 0.1 | 1.5 | 0 |
| Gray | 85.9 | 7.2 | 2.7 | 4.2 |
| Bright | 70.6 | 0.1 | 21.1 | 8.2 |

TABLE 3

Compositions of Phases in FIG. 5

| Phase | Al | Ti | Cu | Ce | Mn |
|---|---|---|---|---|---|
| Matrix | 99.5 | 0 | 0.5 | 0 | |
| Gray1 | 86.2 | 8.2 | 1.0 | 4.6 | |

TABLE 3-continued

Compositions of Phases in FIG. 5

| Phase | Al | Ti | Cu | Ce | Mn |
|---|---|---|---|---|---|
| Gray2 | 79.4 | 0 | 7.6 | 4.5 | 8.5 |
| Bright | 66.3 | 0 | 18.5 | 15.1 | |

Figure 6:
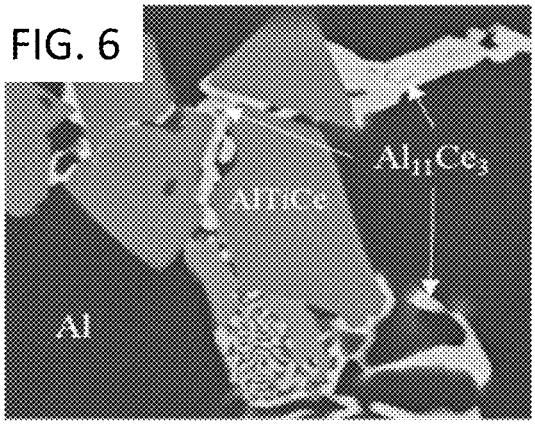
FIG. 6 is an SEM image of a region of an aluminum alloy comprising 8 wt % cerium and having different phases.
Figure 7A:
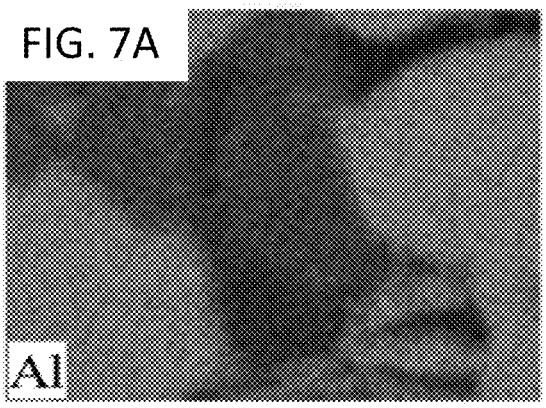
FIGS. 7A-7D are energy dispersive spectroscopy (EDS) element mapping images showing the aluminum (FIG. 7A), titanium (FIG. 7B), copper (FIG. 7C), and cerium (FIG. 7D) content of the region shown in FIG. 6.
Figure 7B:
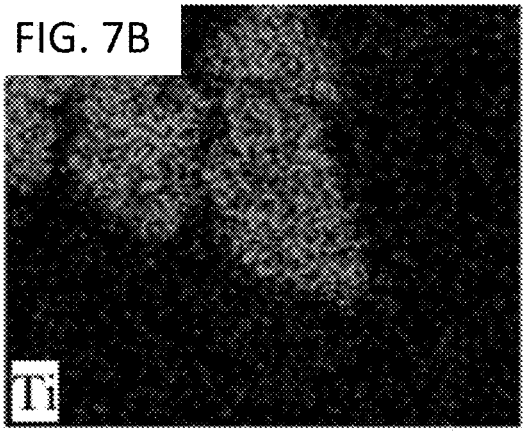
Figure 7C:
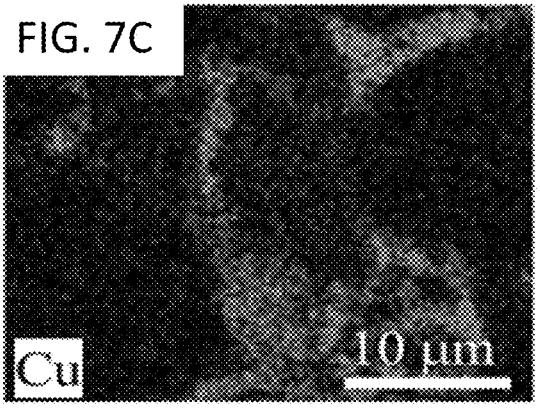
Figure 7D:
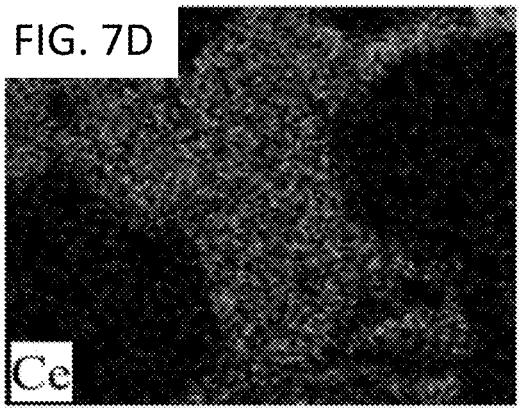

Two phases were used to extract copper and titanium from the alloys, $Al_{11}Ce_3$ and $Al_{20}CeTi_2$. For the Ce-rich alloy (8 wt %), the presence of both Ce-rich phases reduced the level of copper in the matrix to near zero from its nominal composition of 2 atomic %. Contrarily, in the Ce-lean alloy (1 wt %), there is copper remaining in the matrix phase, indicating that the Ce-containing phases have been saturated by Cu. FIG. 6 shows a region of the A206 alloy two which 8 wt % cerium was added and FIGS. 7A-7D show the EDS element mapping of this region. FIG. 7A shows aluminum content, FIG. 7B shows titanium content, FIG. 7C shows copper content, and FIG. 7D shows cerium content. FIGS. 7C and 7D confirm that significant copper is contained in Ce-bearing phases, especially the Al—Ce binary intermetallic.

Figure 8:
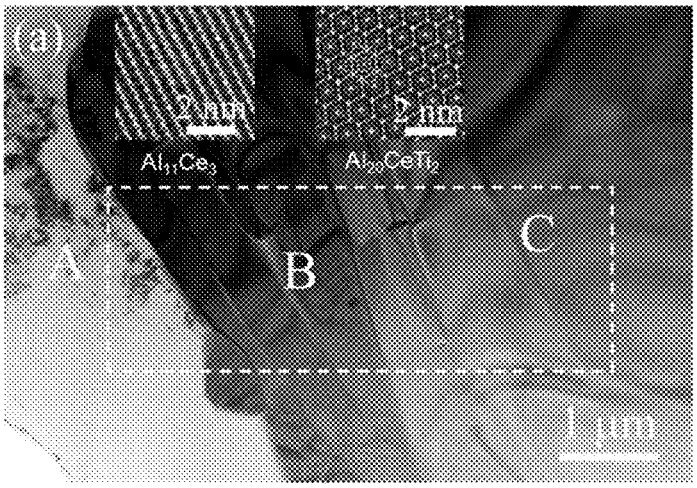
FIG. 8 is a bright-field transmission electron microscopy (BF-TEM) image of an aluminum alloy with 8 wt % cerium addition, with high resolution HAADF-STEM images of $Al_{11}Ce_3$ and $Al_{20}CeTi_2$ inserted.
Figure 9A:
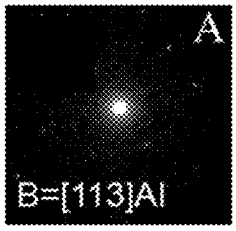
FIGS. 9A-9C are selected area diffraction (SAD) patterns of (i) face-centered cubic (fcc) aluminum as analyzed from region "A" in FIG. 8 (FIG. 9A); (ii) $Al_{11}Ce_3$ as analyzed from region "B" in FIG. 8 (FIG. 9B); and (iii) $Al_{20}CeTi_2$ as analyzed from region "C" in FIG. 8 (FIG. 9C).
Figure 9B:
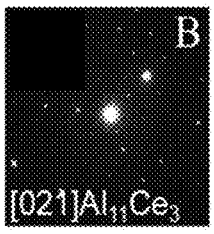
Figure 9C:
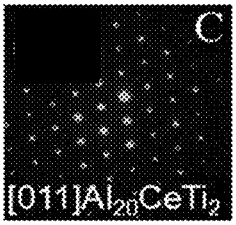
Figure 10A:
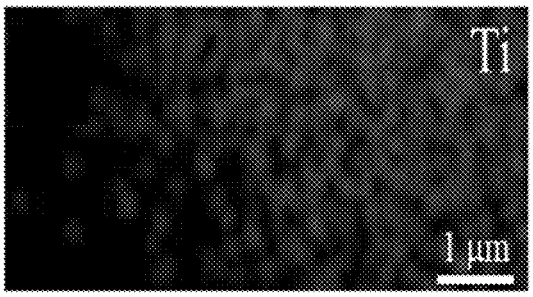
FIGS. 10A-10C are TEM-EDS images showing elemental mapping of titanium (FIG. 10A), copper (FIG. 10B), and cerium (FIG. 100) content from the region illustrated with the dashed box in FIG. 8.
Figure 10B:
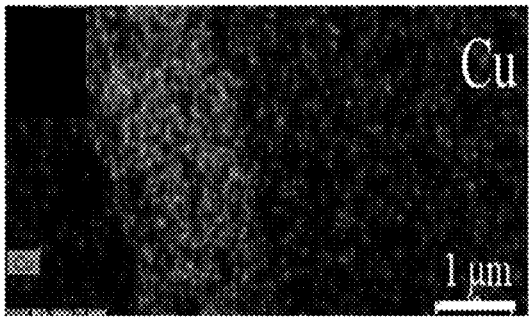
Figure 10C:
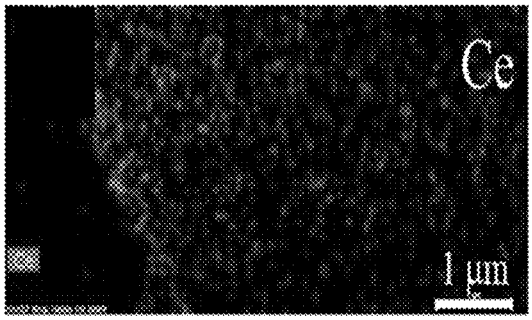

The bright-field TEM image of the Ce-rich A206 alloy is shown in FIG. 8, with high-resolution HAADF-STEM images of two intermetallics, $Al_{11}Ce_3$ and $Al_{20}CeTi_2$, are inserted. The corresponding SAD patterns of particular regions of the alloy are shown in FIGS. 9A-9C. FIG. 9A shows the SAD pattern of the fcc-Al matrix from region A of FIG. 8; FIG. 9B shows the SAD pattern of the $Al_{11}Ce_3$ intermetallic from region B of FIG. 8; and FIG. 9C shows the $Al_{20}CeTi_2$ intermetallic from region C of FIG. 8. The corresponding EDS maps shown in FIGS. 10A-10C confirm that both phases have significant solubility for copper and but the crystal structure has not changed with absorption of Cu.

Example 2

Figure 11:
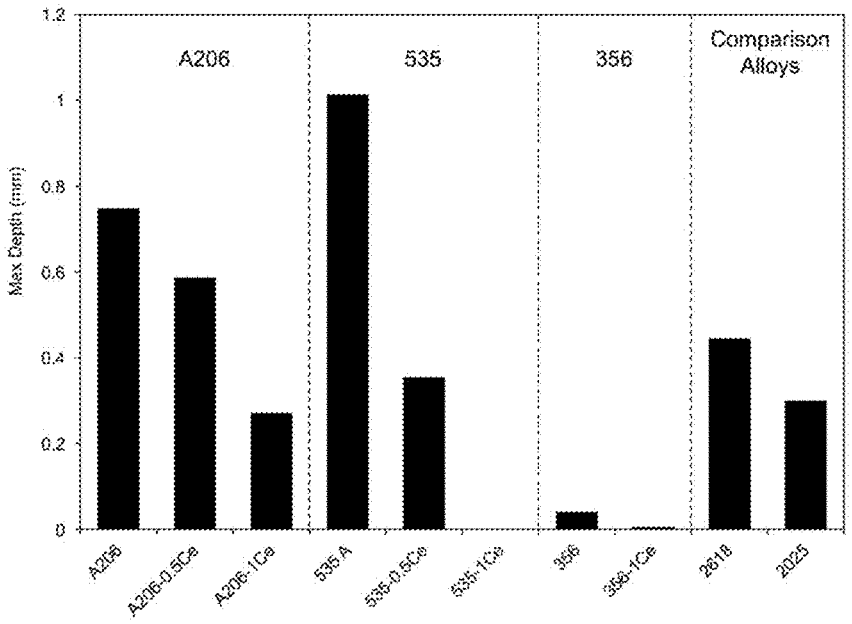
FIG. 11 is a bar graph showing results obtained from performing an ASTM intergranular corrosion test on three different alloys having differing amounts of cerium added, as well as two comparison alloys with no cerium addition.
Figure 12A:
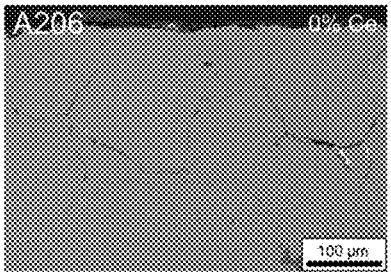
FIGS. 12A-12F are SEM micrographs obtained after intergranular corrosion testing (100 μm scale—FIGS. 12A-12C; and 50 μm scale—FIGS. 12D-12F) of an A206 aluminum alloy with 0 wt % cerium (FIGS. 12A and 12D), 0.5 wt % cerium (FIGS. 12B and 12E), and 1 wt % cerium (FIGS. 12C and 12F).
Figure 12B:
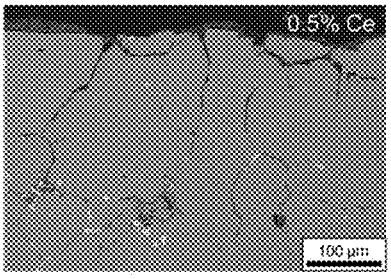
Figure 12C:
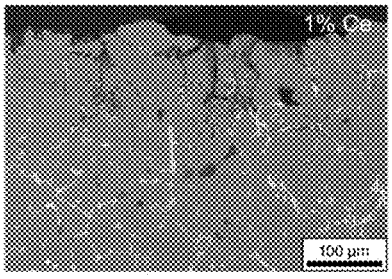
Figure 12D:
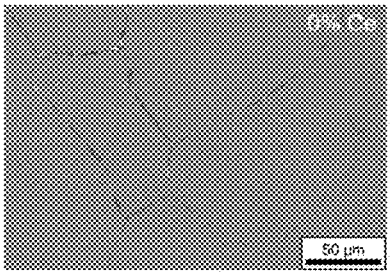
Figure 12E:
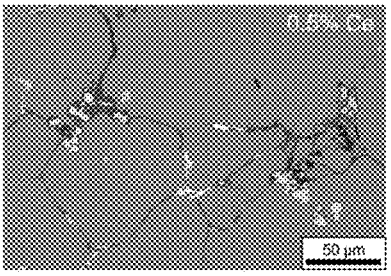
Figure 12F:
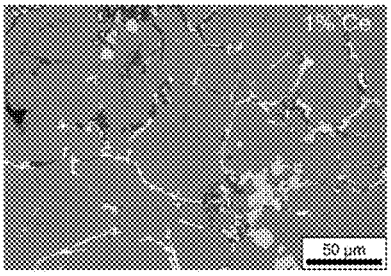
Figure 13A:
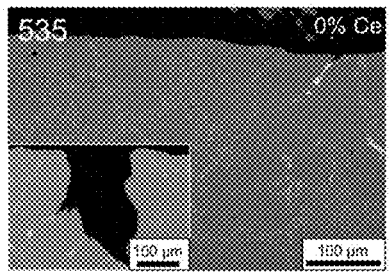
FIGS. 13A-13F are SEM micrographs obtained after intergranular corrosion testing (100 μm scale—FIGS. 13A-13C; and 50 μm scale—FIGS. 13D-13F) of a 535 aluminum alloy with 0 wt % cerium (FIGS. 13A and 13D), 0.5 wt % cerium (FIGS. 13B and 13E), and 1 wt % cerium (FIGS. 13C and 13F) addition.
Figure 13B:
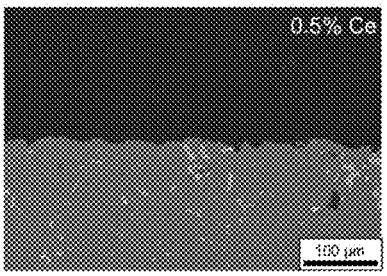
Figure 13C:
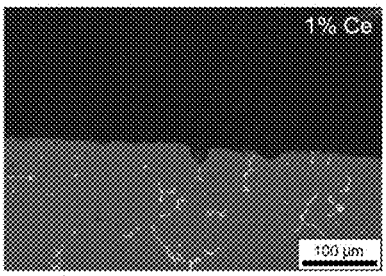
Figure 13D:
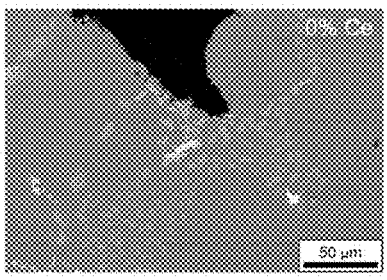
Figure 13E:
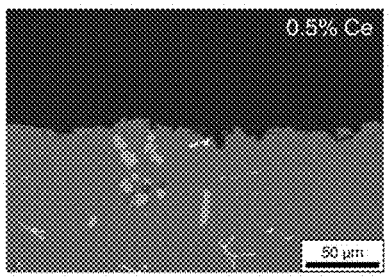
Figure 13F:
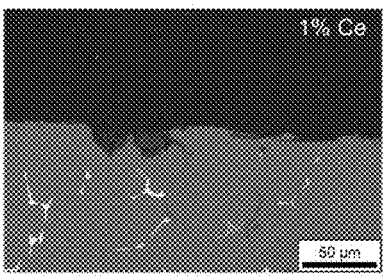
Figure 14A:
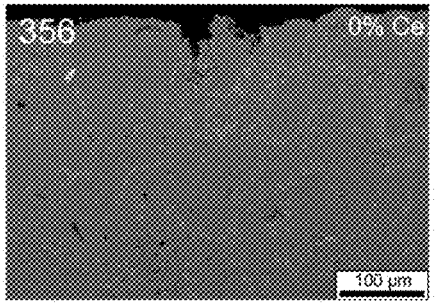
FIGS. 14A-14D are SEM micrographs obtained after intergranular corrosion testing (100 μm scale—FIGS. 14A and 14B; and 50 μm scale—FIGS. 14C and 14D) of a 356 aluminum alloy with 0 wt % cerium (FIGS. 14A and 14C), 0.5 wt % cerium (FIG. 14B), and 1 wt % cerium (FIG. 14D) addition.
Figure 14B:
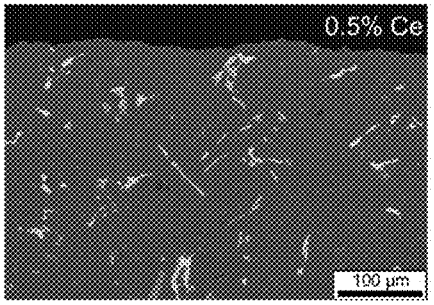
Figure 14C:
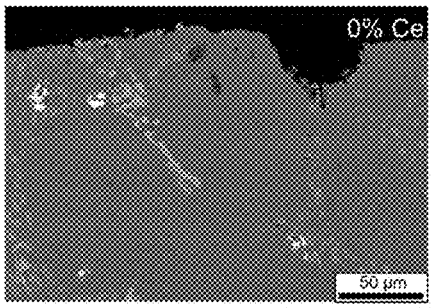
Figure 14D:
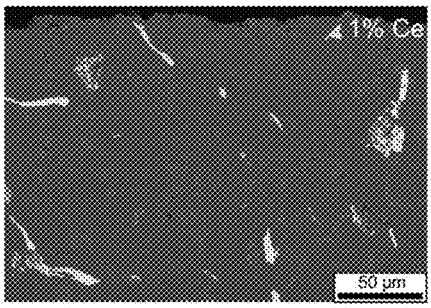
Figure 15A:
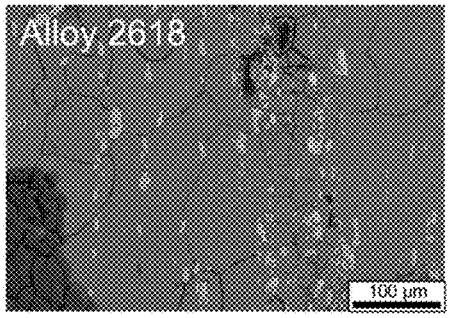
FIGS. 15A and 15B are SEM micrographs obtained after intergranular corrosion testing (100 μm scale—FIG. 15A; and 50 μm scale—FIG. 15B) of a 2618 aluminum alloy with no cerium addition.
Figure 15B:
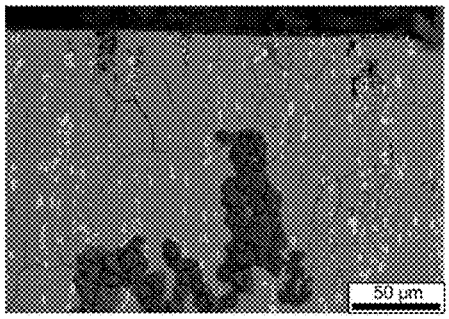
Figure 16A:
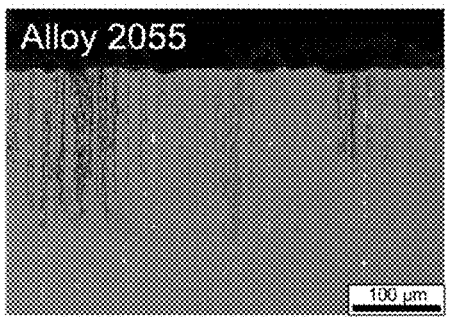
FIGS. 16A and 16B are SEM micrographs (100 μm scale—FIG. 16A; and 50 μm scale FIG. 16B) of a 2055 aluminum alloy with no cerium addition.
Figure 16B:
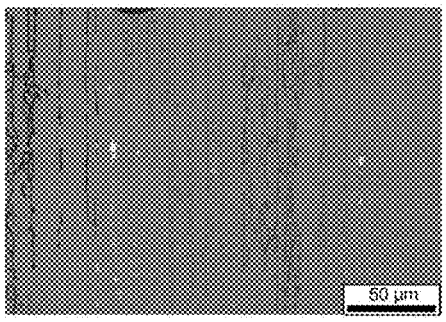
Figure 17A:
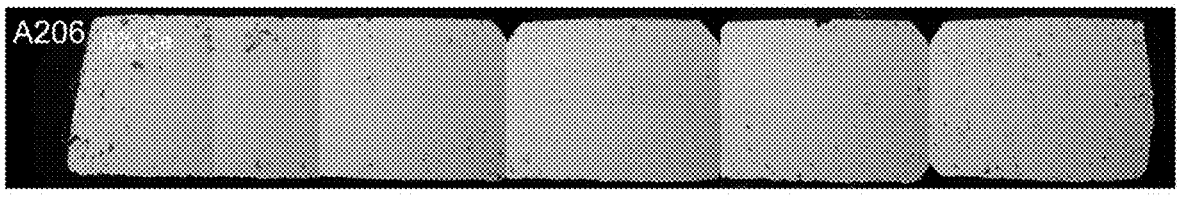
FIGS. 17A-17C show total sample SEM images for an A206 alloy comprising no added cerium (FIG. 17A), 0.5% cerium (FIG. 17B), and 1% cerium (FIG. 17C).
Figure 17B:
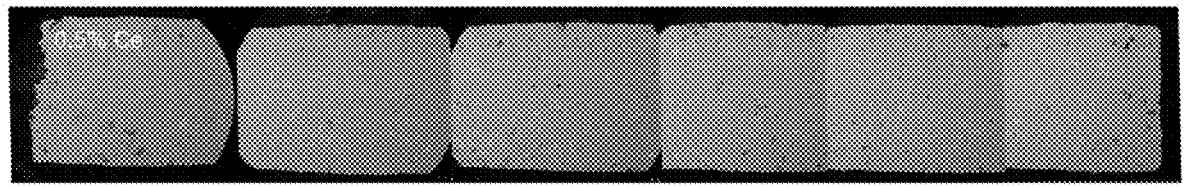
Figure 17C:
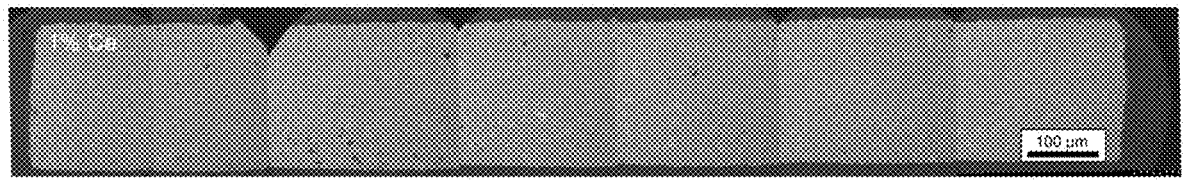
Figure 18A:
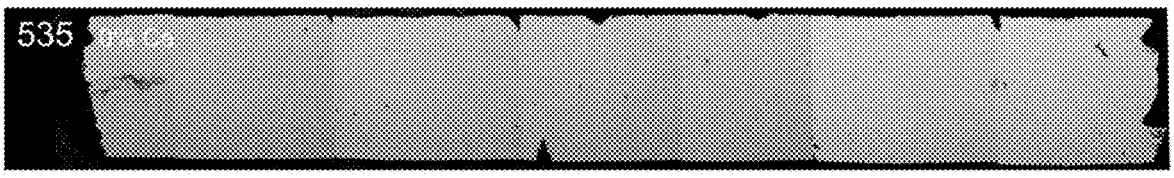
FIGS. 18A-18C show total sample SEM images for a 535 alloy comprising no added cerium (FIG. 18A), 0.5% cerium (FIG. 18B), and 1% cerium (FIG. 18C).
Figure 18B:
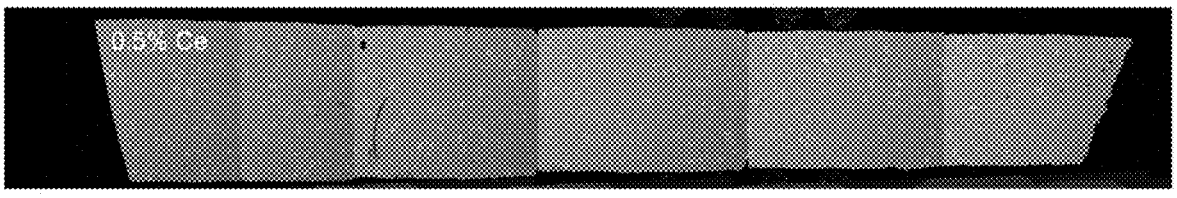
Figure 18C:
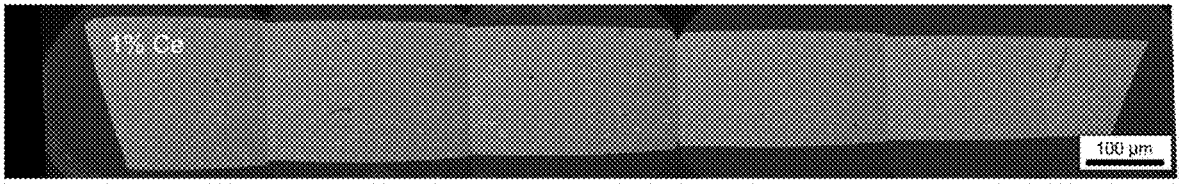
Figure 19A:
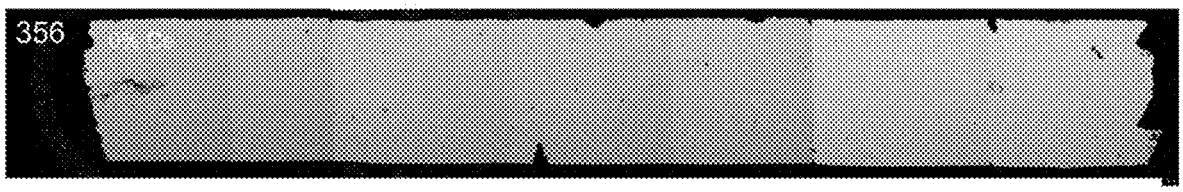
FIGS. 19A and 19B show total sample SEM images for an A356 alloy comprising no added cerium (FIG. 19A) and 1% cerium (FIG. 19C).
Figure 19B:
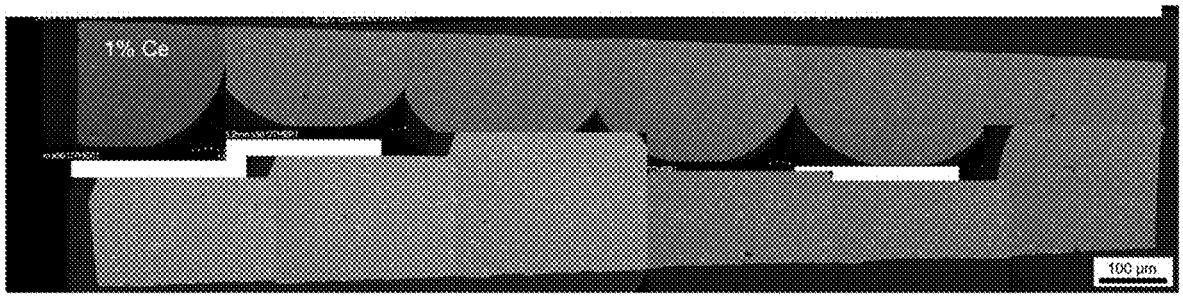

In this example, three commercial aluminum alloys: A206, 535, and 356 were modified with varying amounts of cerium to evaluate IGC reduction effects. These particular alloys are representative of alloys with primary alloying elements of copper, magnesium, and silicon, respectively. The alloys were melted and either 0 wt %, 0.5 wt % or 1.0 wt % cerium was added to the melt, after which the melts were cast into tension bars in a permanent mold. Comparison alloys of aluminum alloys 2618 and 2055 were also prepared. Samples of each alloy were prepared for IGC evaluation by sectioning into disks and grinding the faces with 600 grit SiC paper. Samples were then evaluated by an independent laboratory according to ASTM G110-92: Standard Practice for Evaluating Intergranular Corrosion Resistance of Heat Treatable Aluminum Alloys by Immersion into Sodium Chloride and Hydrogen Peroxide Solution, the results of which are summarized in FIG. 11. Also, the results in FIGS. 12A-12F show the corrosion penetration depth into the sample surface after 7 hours of immersion for alloy A206 at different levels of cerium addition. For alloys A206 and 535, IGC extent was reduced significantly by the inclusion of cerium. While 356 is highly resistant to IGC generally, cerium further improved resistance to IGC. The effect of cerium can be seen especially in A206 in FIGS. 12A-12F, where the cerium sits in grain boundaries, dramatically reducing the extent of intergranular corrosion. This effect was less systematic in alloy 535 (see FIGS. 13A-13F) but there was significant localized corrosion observed that decreased with cerium content. FIGS. 14A-14D show cerium also improved the already good corrosion resistance of alloy 356. The commercially available high-performance aluminum alloys used as a comparison exhibited high levels of intergranular corrosion, as seen in FIGS. 15A, 15B, 16A, and 16B. Overviews of selected total sample cross-sections are shown in FIGS. 17A-17C, 18A-18C, 19A AND 19B.

For the commercial aluminum A206 alloy, cerium additions from 0.5 to 8 wt % significantly increased the volume fraction of secondary phases as shown in FIG. 3. Energy-dispersive X-ray spectroscopy (EDS) elemental mapping performed on A206 with 8 wt % cerium addition (FIGS. 6 and 7) revealed that nearly all the copper and titanium is concentrated in these Ce-containing secondary phases. Copper is prevalent in the bright phase, while the titanium is concentrated in the gray phase that is brighter than the matrix. Transmission electron microscopy (TEM) observation and corresponding selected area diffraction (SAD) patterns (FIG. 9) show that the bright phase present in FIG. 8 is $Al_{11}Ce_3$ and the gray phase is $Al_{20}CeTi_2$ phase. EDS elemental mapping performed in STEM mode (FIG. 10) is consistent with SEM-EDS result, which shows that copper is rich in $Al_{11}Ce_3$ and titanium is in $Al_{20}CeTi_2$ phase.

Example 3

Figure 20:
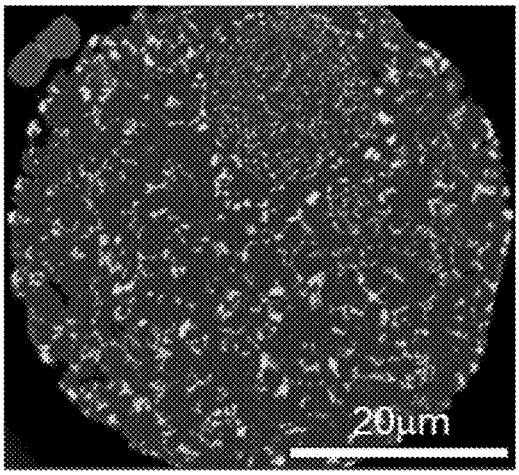
FIG. 20 is an SEM micrograph of Al-8 wt % Ce-10 wt % Mg alloy powder prepared by gas atomization wherein a fine distribution of $Al_{11}Ce_3$ particle distributed in an Al-rich matrix can be observed.
Figure 21:
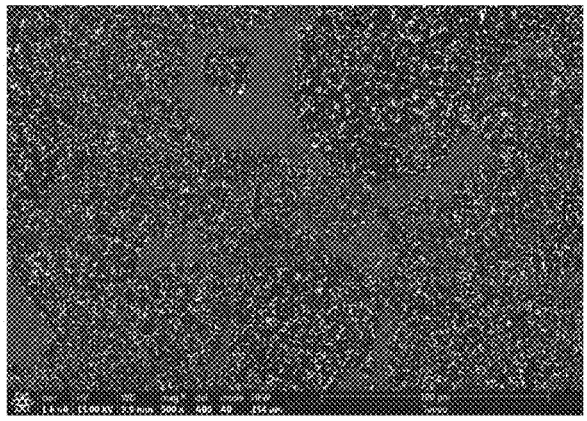
FIG. 21 is an SEM micrograph of Al-8 wt % Ce-10 wt % Mg alloy powder that has been consolidated to thermomechanical processing, wherein the large plastic deformation is analogous to cold spray processing.

FIG. 20 shows the microstructure of powders an Al 8 wt % Ce and 10% Mg alloy produced by gas atomization. The refined microstructure, which is due to the high cooling rate during atomization, can be maintained or further refined via the different deposition techniques described above. For example, cold spray deposition utilizes kinetic energy to plastically deform particles, which creates a strong and dense coating. FIG. 21 shows a typical microstructure of an Al 8 wt % Ce and 10% Mg alloy after undergoing large plastic deformation similar to cold spray deposition. The refined microstructure provides for good strength and ductility, but also very good thermal stability, and thus, maintains high strength during prolonged exposures to high temperatures.

Figure 22:
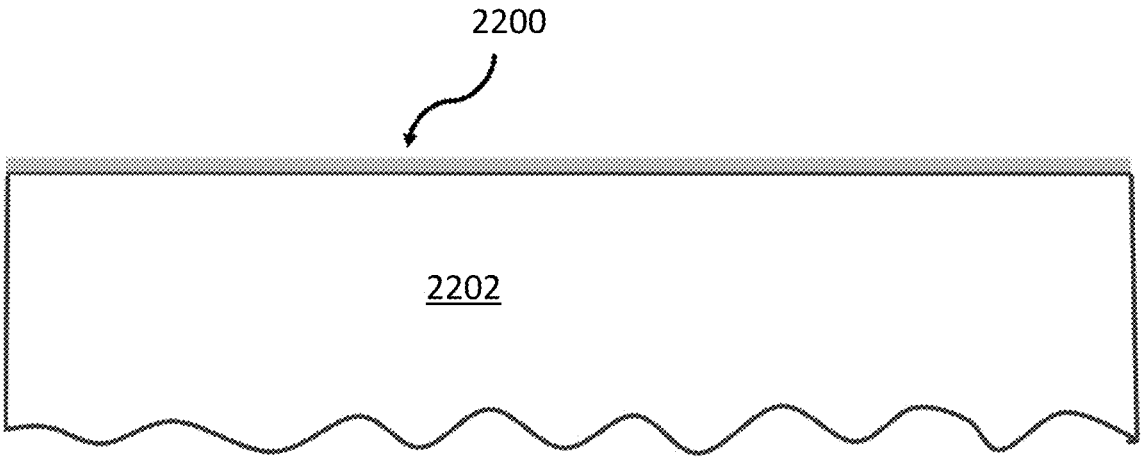
FIG. 22 is a schematic illustration of a representative Al—Ce based coating on a base alloy.

A schematic of the protective coating alloy 2200 on a base alloy 2202 is shown in FIG. 22. The thickness of the coating can vary as well as the deposition method. The coating provides good adhesion, high strength and excellent corrosion resistance.

Example 4

Figure 23A:
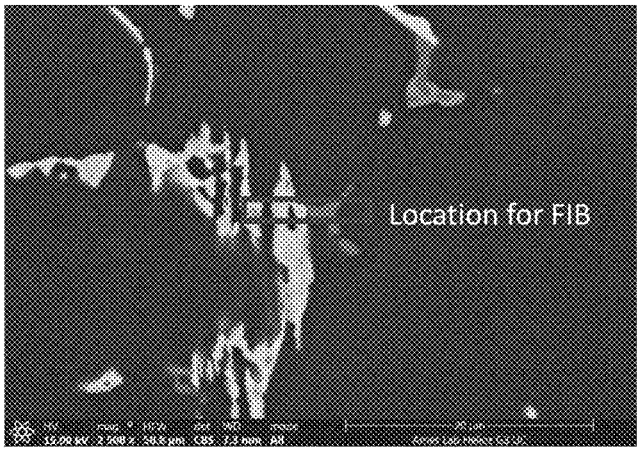
Figure 23B:
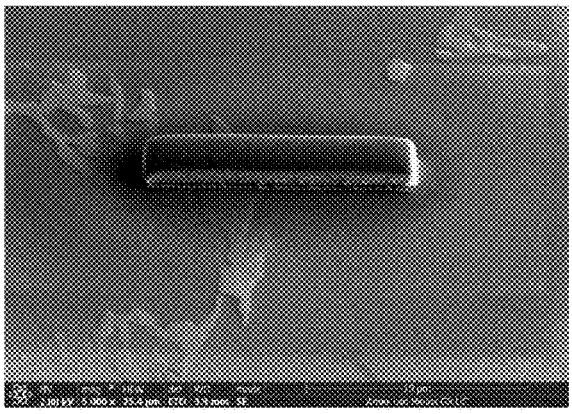
Figure 23C:
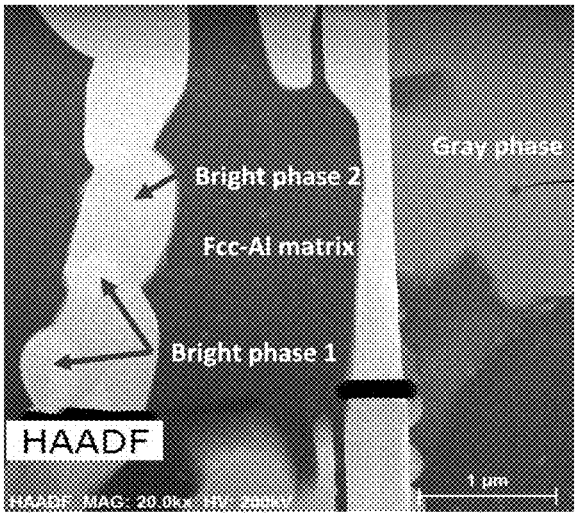
Figure 23D:
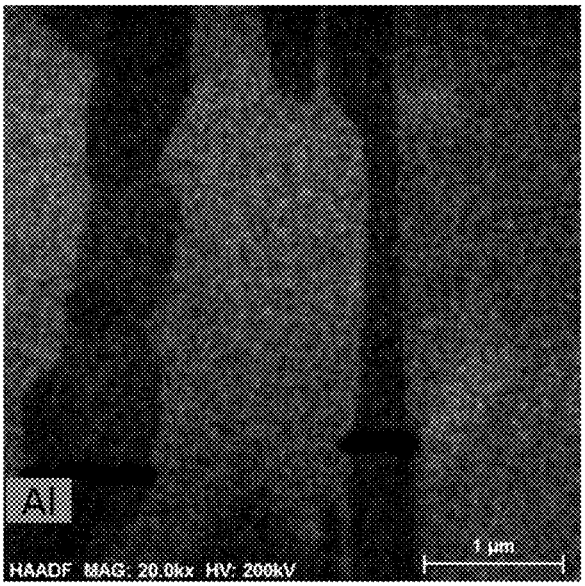
Figure 23E:
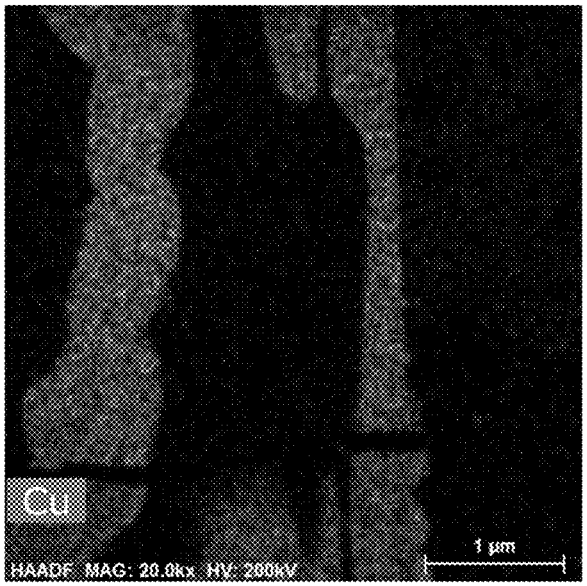
Figure 23F:
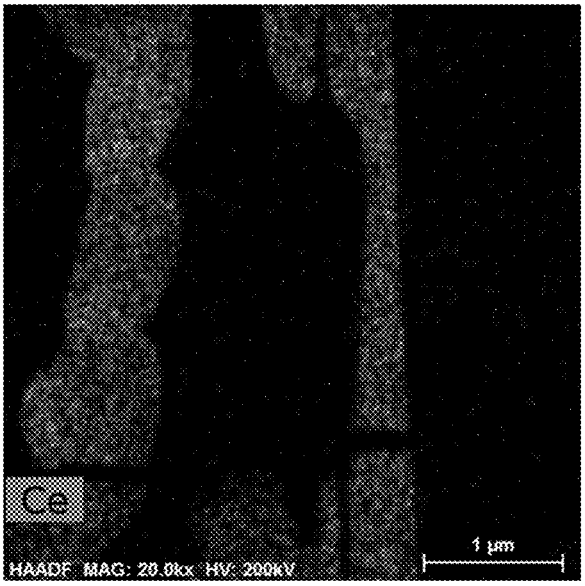

In this example, an additional alloy embodiment was evaluated for the ability of a rare earth element (namely, cerium) to capture copper present in an aluminum alloy. Results are provided by FIGS. 23A-23F, wherein FIGS. 23A and 23B show the location used for the focused ion beam in this example. As can be seen by FIG. 23D, very little to no copper remains in the aluminum matrix and instead is captured within an Al/REE intermetallic (as compared with FIGS. 23E and 23F, which indicate that the copper is confined to areas with Ce).

It was determined that the copper was present in two different intermetallics, an Al—Ce—Cu intermetallic and an Al—Ce—Si—Cu intermetallic. Tables 4 and 5 below provide the EDS composition readouts for different regions of the alloy, namely two bright phases (bright phase 1 and bright phase 2), the fcc-aluminum matrix, and a gray phase (as shown in FIG. 23C).

TABLE 4

| Phases | Aluminum w % | Si w % | Ti w % | Mn w % | Fe w % | Cu w % | Ce w % |
|---|---|---|---|---|---|---|---|
| FCC-Al | 97.36 | 0.00 | 0.00 | 0.16 | 0.00 | 2.45 | 0.03 |
| Gray | 57.65 | 4.97 | 0.00 | 10.48 | 21.91 | 4.99 | 0.00 |
| Bright 1 | 22.54 | 4.89 | 0.01 | 0.00 | 0.23 | 35.39 | 36.93 |
| Bright 2 | 30.57 | 0.01 | 0.00 | 2.66 | 0.65 | 39.05 | 27.04 |

TABLE 5

| Phases | Aluminum at % | Si at % | Ti at % | Mn at % | Fe at % | Cu at % | Ce at % |
|---|---|---|---|---|---|---|---|
| FCC-Al | 98.85 | 0.00 | 0.00 | 0.08 | 0.00 | 1.06 | 0.01 |
| Gray | 71.78 | 5.96 | 0.00 | 6.42 | 13.20 | 2.64 | 0.00 |
| Bright 1 | 45.49 | 9.52 | 0.01 | 0.00 | 0.23 | 30.37 | 14.38 |
| Bright 2 | 56.58 | 0.02 | 0.00 | 2.42 | 0.58 | 30.73 | 9.65 |

In view of the many possible embodiments to which the principles of the present disclosure may be applied, it should be recognized that the illustrated embodiments are only examples and should not be taken as limiting. Rather, the scope of the present disclosure is defined by the following claims. We therefore claim as our invention all that comes within the scope and spirit of these claims.

We claim:

1. An aluminum alloy, comprising copper, magnesium in an amount ranging from 0.27 wt % to 8 wt %, a rare earth element (REE) component selected from cerium, lanthanum, or a combination thereof, wherein the total amount of the rare earth element (REE) component ranges from greater than 1 wt % to 4 wt %; iron, and balance of aluminum and trace impurities, wherein the aluminum alloy has an $Al_{11}REE_3$ intermetallic phase, wherein Al is aluminum and the REE is cerium, lanthanum, or a combination thereof, and wherein at least 40% of all copper and at least 60% of all iron present in the aluminum alloy is contained in the $Al_{11}REE_3$ intermetallic phase.

2. The aluminum alloy of claim 1, wherein the aluminum alloy comprises copper in grain boundaries of the aluminum alloy and wherein 80% of any such copper present is contained in the $Al_{11}REE_3$ intermetallic phase.

3. The aluminum alloy of claim 1, wherein the REE is cerium.

4. The aluminum alloy of claim 1, wherein the $Al_{11}REE_3$ intermetallic phase comprises an atomic % of copper and an atomic % of the REE that provides a ratio ranging from 2.1:1 to higher than 2.1:1 (copper:REE).

5. The aluminum alloy of claim 4, wherein the ratio ranges from 2.1:1 to 3:1.

6. The aluminum alloy of claim 4, wherein the ratio ranges from 2.1:1 to 2.6:1.

7. The aluminum alloy of claim 1, wherein the alloy comprises one or more intermetallics having a formula selected from $Cu(REE)Al_3$, $Cu_4(REE)Al_8$, or $Cu_7(REE)_2Al_{10}$.

8. The aluminum alloy of claim 1, wherein the copper is present in an amount ranging from 0.1 wt % to 7 wt %.

9. The aluminum alloy of claim 1, further comprising titanium in an amount ranging from greater than 0 wt % to 0.3 wt %; and wherein the magnesium is present in an amount ranging from greater than 0.27 wt % to 3 wt % and the iron is present in an amount ranging from greater than 0 wt % to 2 wt %.

10. The aluminum alloy of claim 9, wherein the aluminum alloy further comprises an Al-REE-Ti ternary intermetallic phase and wherein the Al-REE-Ti ternary phase comprises an atomic % of titanium and an atomic % of the REE that provides a ratio of REE to titanium ranging from 0.3:1 to higher than 0.3:1.

11. The aluminum alloy of claim 1, further comprising silicon, manganese, zinc, chromium, or zirconium.

12. A method for making the alloy of claim 1, comprising:

melting a solid aluminum-based alloy comprising aluminum, copper, iron, magnesium, and titanium and that is free of a rare earth element to provide a molten aluminum-based alloy;

adding to the molten aluminum-based alloy a rare earth element (REE) component selected from cerium, lanthanum, or a combination thereof, to form a molten REE-modified aluminum-based alloy, wherein the REE component is added in an amount sufficient to form the $Al_{11}REE_3$ intermetallic capable of isolating an amount of the copper or the titanium present in the molten REE-modified aluminum-based alloy from an aluminum matrix; and allowing the molten REE-modified aluminum-based alloy to solidify, thereby providing a solidified molten REE-modified aluminum-based alloy having increased intergranular corrosion resistance as compared to a solidified aluminum-based alloy that is not modified with an REE.

13. The method of claim 12, wherein adding the REE changes the chemical composition of grain boundary precipitates within the molten aluminum-based alloy such that the grain boundary precipitates become more anodic than grain boundary precipitates present in a solidified aluminum-based alloy that is not modified with an REE.

14. The method of claim 12, wherein adding the REE changes the chemical composition of grain boundary precipitates within the molten aluminum-based alloy such that the galvanic potential difference between the grain boundary precipitates and precipitate free zones and the galvanic potential difference between the grain boundary precipitates and a grain matrix are both less than 0.020V.

15. The method of claim 12, wherein the presence of the $Al_{11}REE_3$ intermetallic capable of isolating an amount of the copper or the titanium present in the molten REE-modified aluminum-based alloy from an aluminum matrix is determined using scanning electron microscopy and/or energy dispersive spectroscopy.

16. The method of claim 12, wherein the amount of the REE added to the molten aluminum-based alloy ranges from greater than 0 wt % to 4 wt %.

17. The method of claim 12, wherein the amount of the REE added to the molten aluminum-based alloy ranges from 0.1 wt % to 1 wt %.

18. A method, comprising forming a coating on a base alloy by depositing the aluminum alloy of claim 1 on a surface of the base alloy, wherein the base alloy is more susceptible to corrosion than the aluminum alloy of claim 1.

19. The method of claim 18, wherein depositing comprises cold spray deposition, twin-wire arc deposition, thermal spray deposition, roll bonding deposition, electrodeposition, physical vapor deposition, or additive manufacturing deposition.

* * * * *